US012790810B2

(12) United States Patent
Kushner

(10) Patent No.: US 12,790,810 B2
(45) Date of Patent: Nov. 10, 2026

(54) FOLDABLE STRUCTURE AND METHOD

(71) Applicant: Alexander Kushner, San Francisco, CA (US)

(72) Inventor: Alexander Kushner, San Francisco, CA (US)

( * ) Notice: Subject to any disclaimer, the term of this patent is extended or adjusted under 35 U.S.C. 154(b) by 168 days.

(21) Appl. No.: 18/778,809

(22) Filed: Jul. 19, 2024

(65) Prior Publication Data

US 2026/0022553 A1 Jan. 22, 2026

(51) Int. Cl.
*E04B 1/34* (2006.01)
*E04B 1/343* (2006.01)
*E04B 1/344* (2006.01)

(52) U.S. Cl.
CPC ..... *E04B 1/344* (2013.01); *E04B 1/34384* (2013.01)

(58) Field of Classification Search
CPC .... E04B 1/34384; E04B 1/344; E04B 1/3442; E04B 1/3445; B62D 53/067; E04H 2001/128; E04H 2001/1283
USPC ..... 52/79.5
See application file for complete search history.

(56) References Cited

U.S. PATENT DOCUMENTS 3,653,165 A * 4/1972 West ..... E04B 1/344 52/67
2003/0056446 A1* 3/2003 Napier ..... E04B 7/16 52/66
2009/0193725 A1* 8/2009 Harrisson ..... E04B 7/16 52/66
2018/0162463 A1* 6/2018 Lutz ..... B62D 53/06
2021/0246675 A1* 8/2021 Pearce ..... E04H 1/12
2024/0384524 A1* 11/2024 Chen ..... E04B 1/343

* cited by examiner

*Primary Examiner* — Joshua J Michener
*Assistant Examiner* — Henry Hooper Mudd
(74) *Attorney, Agent, or Firm* — INTELLECTUAL PROPERTY LAW GROUP LLP

(57) ABSTRACT

Described is a system, method and apparatus for stowing and deploying a roof of a structure in order to transport the structure on municipal streets and highways. An upper portion of a structure comprises two gable walls that are foldable inward, on top of a first floor of the structure. The roof is formed from two independent roof panels that are coupled to each other by a main roofline hinge. Each roof panel is allowed to slide and rotate as the roof is being stowed. When fully stowed, the height of the structure is drastically reduced. Additionally, one or more end structures may be constructed adjacent to a main structure, each end structure capable of being rotated onto one side in order to reduce its height.

21 Claims, 26 Drawing Sheets

FOLDABLE STRUCTURE AND METHOD

BACKGROUND

I. Field of Use

The present application relates to the home and commercial construction industry. More specifically, the present application relates to a system, apparatus and method for constructing modular, factory-built homes and other structures that are collapsible for easy transportation to job sites.

II. Description of the Related Art

There currently exists a major housing shortage in the United States. One of the solutions to this problem is the use of prefabricated or modular structures, otherwise known as factory-built homes. These structures are typically manufactured in sections at a controlled factory environment and then shipped to a final destination for assembly and occupancy. These homes are typically much less expensive than traditional "site-built" homes and can be manufactured in far less time and with less waste.

However, transporting such pre-fabricated homes on public streets and highways can be challenging, because of the height of some pre-fabricated homes. For example, the production of two-story, pre-fabricated homes is limited, because they generally cannot be transported on public streets and highways because they cannot pass underneath overpasses, utility wires or traffic signal wires.

It would be desirable, then, to manufacture two-story, pre-fabricated homes in such a way that they can easily be transported on public streets and highways.

SUMMARY

The embodiments described herein relate to a system, apparatus and method for temporarily reducing the height of a structure in order to transport the structure over municipal streets and highways. The structure is then deployed once the structure reaches its intended, permanent location.

In one embodiment, a structure is described, comprising a horizontal top frame that defines a perimeter of the structure, a first gable wall rotatably coupled to a first portion of the horizontal top frame, a second gable wall rotatably coupled to a second portion of the horizontal top frame, and a foldable roof, comprising an apex, the apex defining a maximum height of the structure when the foldable roof is in a deployed position and a height less than the maximum height when the foldable roof is in a stowed position.

In another embodiment, a method for stowing a roof of a structure comprises lowering a first gable wall coupled to a top horizontal frame of the structure via a first hinge, lowering a second gable wall coupled to the top horizontal frame of the structure via a second hinge, and lowering a roof of the structure to reduce a height of the structure from a first height to a second height.

BRIEF DESCRIPTION OF THE DRA WINGS

The features, advantages, and objects of the present invention will become more apparent from the detailed description as set forth below, when taken in conjunction with the drawings in which like referenced characters identify correspondingly throughout, wherein the drawings may not be to scale, and wherein.

Figure 23:
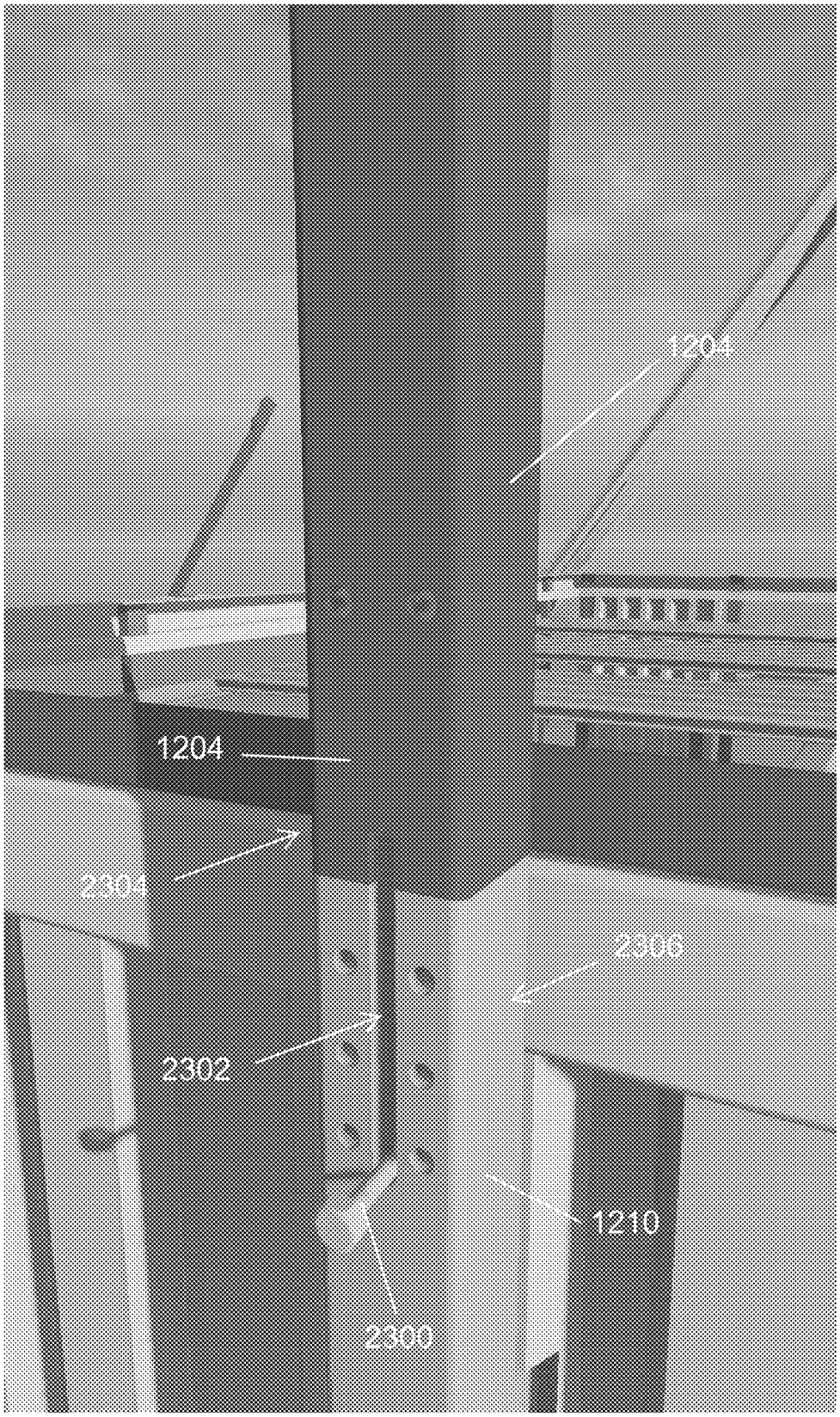
FIG. 23 is a close-up, perspective, cutaway view of one embodiment of a structure where additional structural reinforcement has been added in the form of configurable reinforcement means.
Figure 24:
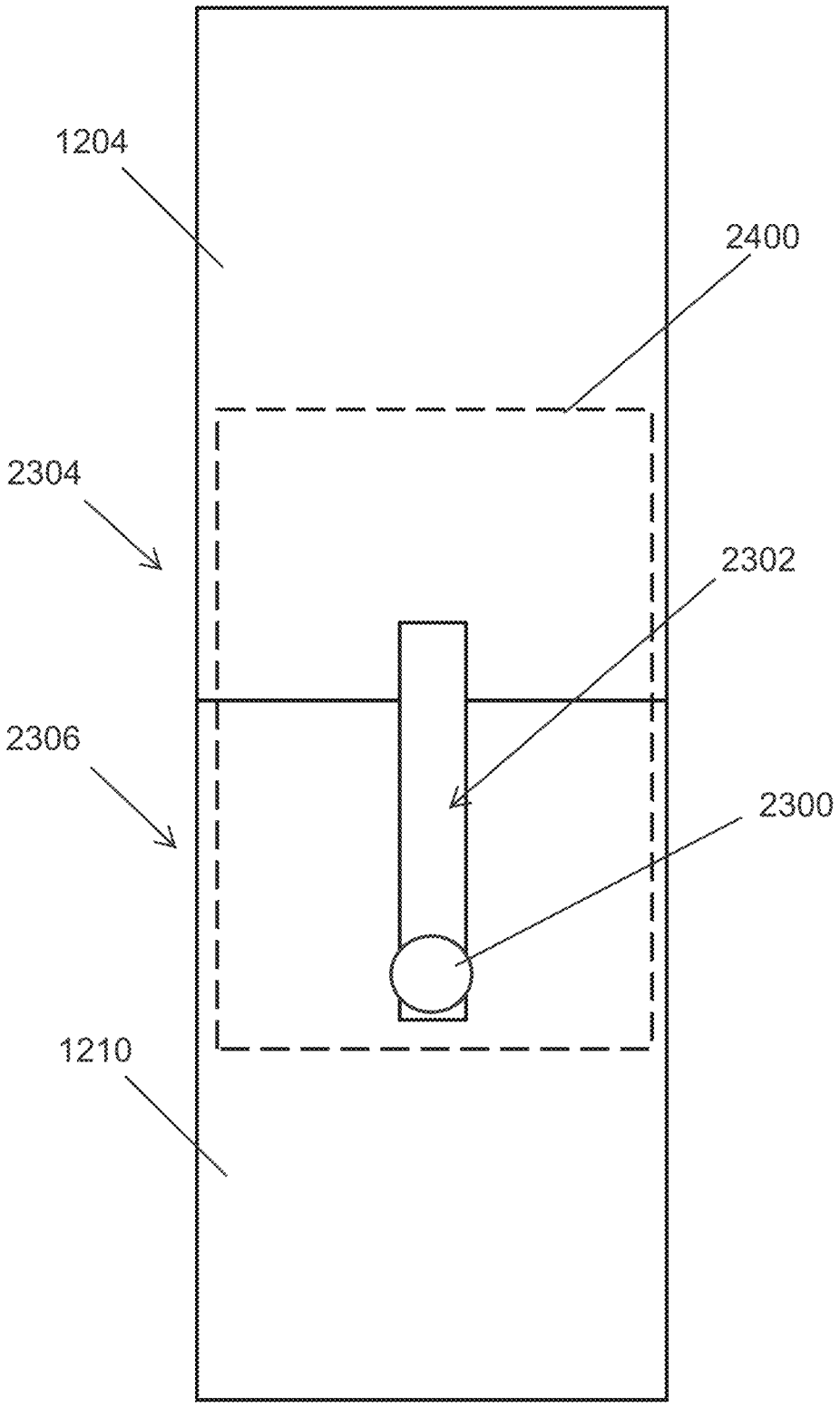
Figure 25:
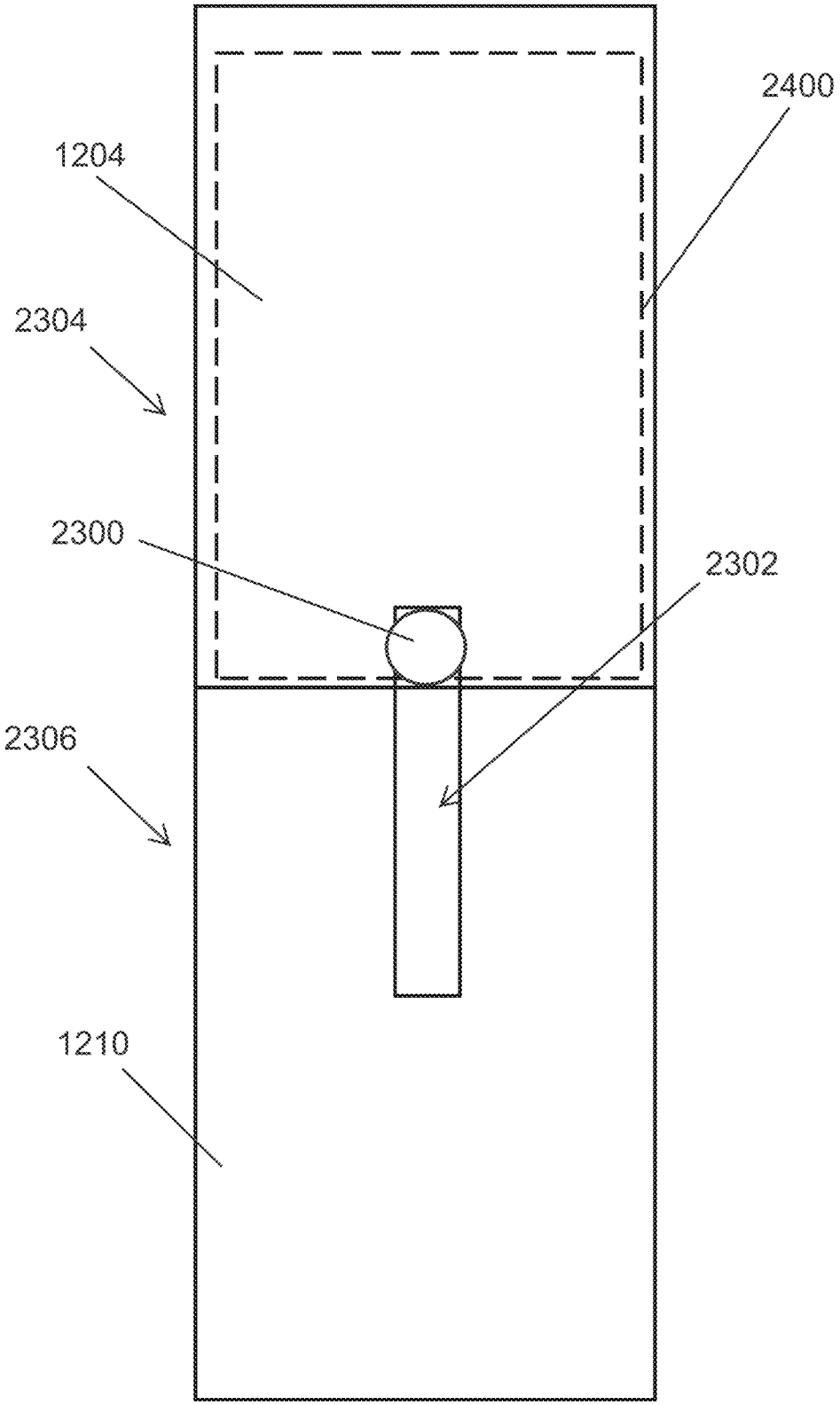

FIG. 24 is a front, plan view of the configurable reinforcement means as shown in FIG. 23, shown in a locked position, illustrating a hidden, slidable insert as well as other components shown in FIG. 23; and FIG. 25 is the same front, plan view of the configurable reinforcement means as shown in FIGS. 23 and 24, shown in an unlocked position, again illustrating the hidden slidable insert, as well as the other components described with respect

DETAILED DESCRIPTION

The present application describes embodiments of a system, apparatus and method for constructing a foldable and/or rotatable structure to minimize its height for transportation over streets and highways. In one embodiment, a foldable structure comprises a lower, fixed portion, i.e., the first story of a home, and an upper portion comprising two, opposing, gable walls that are each mechanically coupled to the lower portion via one or more respective hinges. A roof comprises two roof panels that are hingedly coupled together at an apex. When the structure is ready for transport, the gable walls are folded inwards over the first story and the roof is dropped down on one side, thereby lowering the overall height of the structure significantly. Constructing structures in this way allows more of the structure to be built at a factory, rather than having to raise walls in place and then perform tasks such as drywalling, taping, finishing, painting, and installing doors and trim.

In another embodiment, a structure may comprise a height that is greater than its width. In this case, the structure may be pivoted 90 degrees to lie on a side wall, thus reducing the height of the structure equal to the width.

There are numerous benefits of a foldable and/or rotatable structure configured for quick and easy stowing and deployment. A first benefit is that in many cases, a single truck delivery is all that is needed to construct a structure at a job site. In other cases, the number of truck deliveries to a job site is greatly reduced. In any case, large reductions in construction costs are achieved. Normally, it may require two or more trucks to deliver same amount of living space as a single load comprising a foldable/rotatable structure. Another benefit of using fewer truck deliveries is a savings of approximately 3.71 lbs/mile of CO2 emissions. For example, construction of 100 homes with an average distance from a factory to a home site of 100 miles round trip may save prevent 75,000 lbs of CO2 from being emitted into the atmosphere.

Another benefit of a foldable and/or rotatable structure is that in many cases, no crane is required at the construction site. This results in a large cost savings of not having to purchase or lease a crane and the emissions saved by not having to transport a crane to a construction site.

Yet another benefit of a foldable and/or rotatable structure is that a complete, multi-story structure can be built at a factory complete with all walls, doors, finishes, hardware, tiling, showers, toilets, etc. installed. This eliminates costly on-site work to install such items. This relates especially to configurable structures whose roof may be lifted up to make space for a second floor living space, or when a roof is hinged and lifted up to make attic space.

Yet still another benefit of a foldable and/or rotatable structure is that in many cases, a framed ceiling is not needed on a first living space. In this case, the floor of the upper living space acts as the ceiling of the lower living space. This results in substantial cost savings.

To highlight some of these benefits, in one example, the following costs may be incurred when building a conventional structure:

Two truckloads, each for transporting a sub-structure module, and one crane: $5,000+$5,000+$5,000=15,000, plus labor costs of $3,000 to connect the two modules together, or about $18,000 per home. $18,000/1,320 sq. feet home=$13.64 per sq. foot, which is the average cost of delivery and setting up a conventional modular 1,320 sq. foot home.

Using the inventive concepts disclosed herein, the above costs may be reduced substantially, as follows:

One truck delivery, no crane: $5,000/1,320 sq. feet=$3.78 per sq. foot. A additional cost savings may be achieved by utilizing a floor of an upper level to act as a ceiling of a lower level, which may save an additional $10,000, $7.58 per sq. foot in this example.

In summary, a foldable and/or rotatable structure may save up to $17.44 per sq. foot or more of the cost to construct a new home, or total savings of $23,000 per each home.

Figure 1:
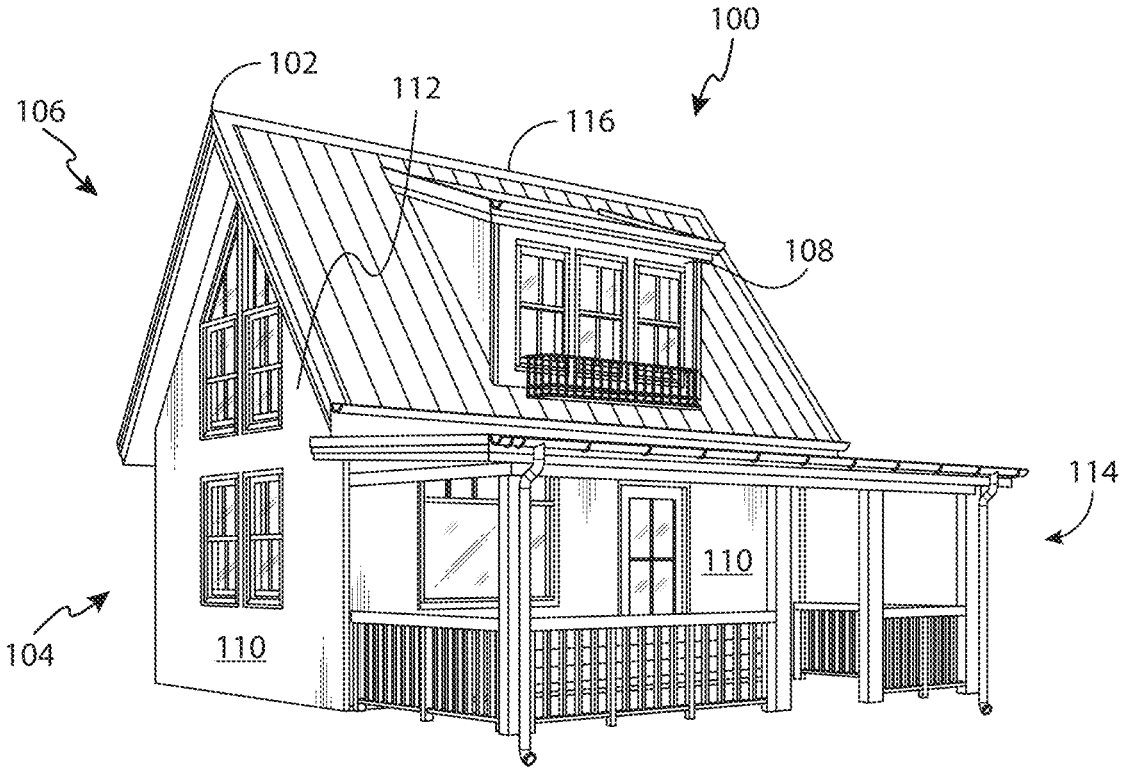
FIG. 1 is a perspective view of one embodiment of a foldable structure.

FIG. 1 is a perspective view of one embodiment of a foldable structure 100, in this embodiment, a small, two-story home, having an apex 102 and a roofline 116 that is generally higher than practical to transport structure 100 over roadways. In other words, apex 102 and roofline 116 is higher than most highway overpasses and/or local electrical/telephone/traffic signal wires. In other embodiments, structure 100 may comprise a single-story structure with a relatively high apex 102 and roofline 116. In general, structure 100 comprises a single or multi-story home, office building or any other structure suitable for housing people or objects having an apex 102 and roofline 116 higher than practical to transport structure 100 over roadways.

In the embodiment shown in FIG. 1, structure 100 comprises a first story 104 and a second story 106, with second story 106 comprising, in this example, a dormer 108. Reference to second story 106 henceforth shall refer both to structures having a second story and structures having a single story but apex 102 and roofline 116 higher than practical to transport structure 100 over roadways. First story 104 comprises three or more stationary, lower static walls 110 (two of four of such walls shown in FIG. 1, while two other lower walls are hidden from view), while second story 106 comprises two or more foldable, gable walls, a left gable wall 112 is shown, while a second, opposing gable wall is hidden from view in this view. The second gable wall, in this example, is substantially similar in size and shape as left gable wall 112. Structure 100 additionally comprises, in this example, porch 114. Both porch 114 and dormer 108 are optional features of structure 100. For the remainder of this disclosure, reference to porch 114 and dormer 108 will be omitted.

Structure 100 may be constructed off-site, at a construction facility, and then transported by roadway to a building site after folding, or stowing, second story 108 in order to reduce the height of structure 100, as shown in FIGS. 3-6. In the embodiment shown in FIG. 1, structure 100 is approximately 18 feet wide, 12 feet deep (not including porch 114) and 18 feet high. Of course, in other embodiments, these dimensions may vary.

Figure 2:
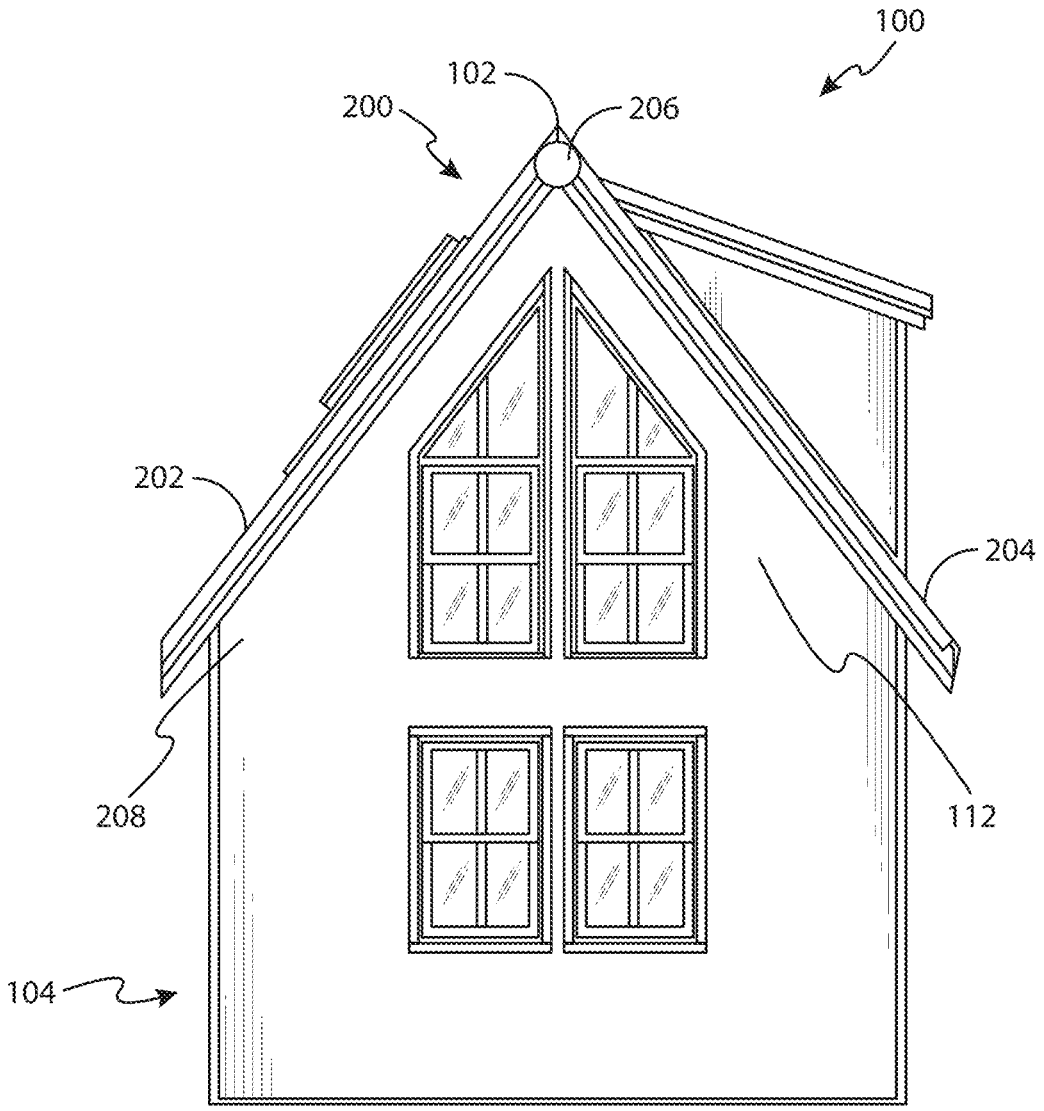
FIG. 2 is a left, side view of the foldable structure as shown in FIG. 1, more clearly showing a roof comprising a first roof panel and second roof panel coupled together via a roofline hinge.

FIG. 2 is a left, side view of foldable structure 100 as shown in FIG. 1, more clearly showing roof 200 comprising first roof panel 202 and second roof panel 204, hingedly coupled together at apex 102 via a roofline hinge 206. Roofline hinge 206 may be formed from one or more separate hinges, or comprise a continuous structure running the along the length of roofline 204, shown in greater detail later herein. A lower edge 208 of left gable wall 112 is shown coupled via one or more hinges or hinge-like structures 210 (shown in dashed lines in this view) to a top portion of first story, such as to a top horizontal frame (hidden in this view) of first story 104, to a floor of second story 106, or to some other portion of structure 100.

Figure 3:
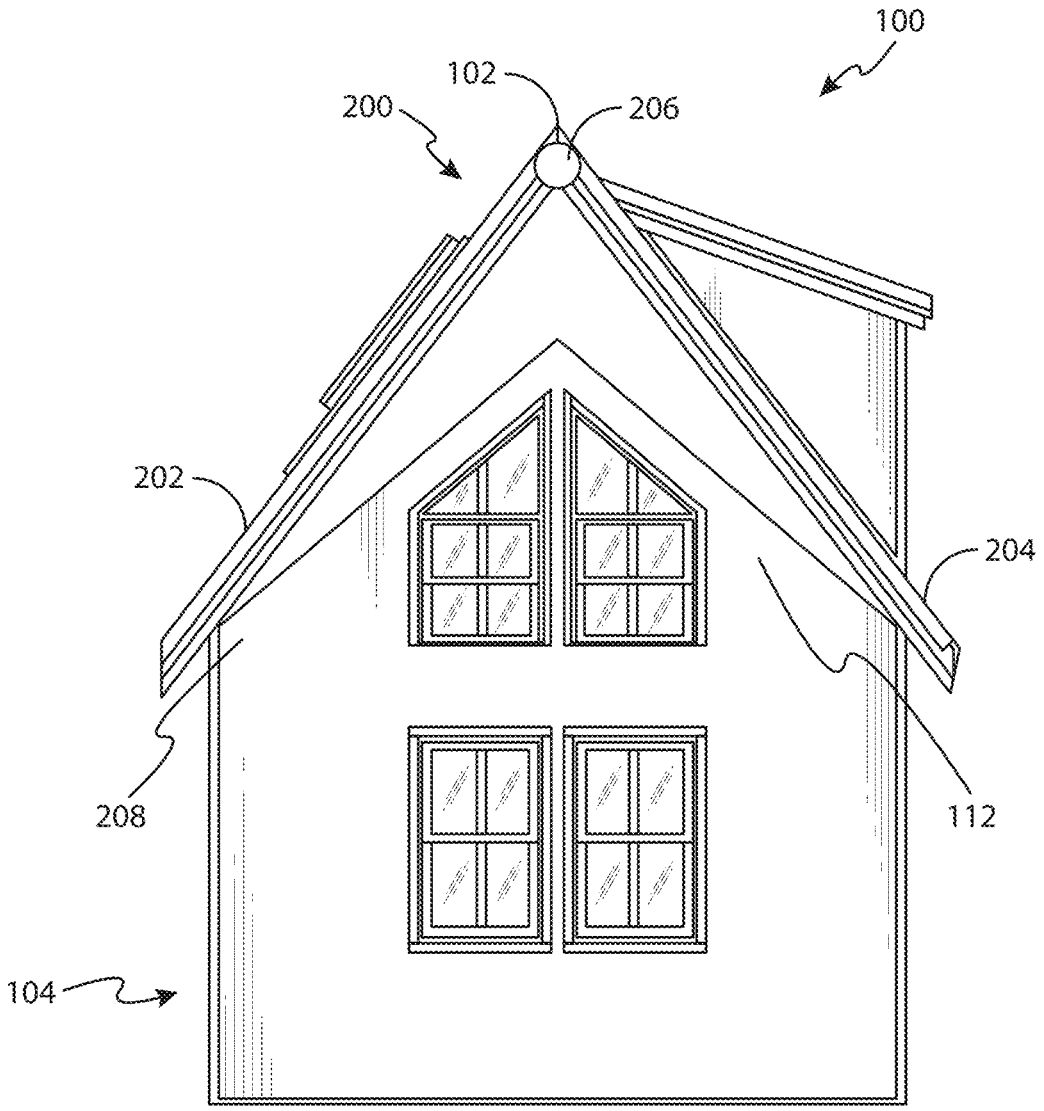
FIG. 3 is a left, side view the foldable structure as shown in FIG. 2, illustrating the start of a "folding" or "stowing" process to lower the overall height of the structure.

FIG. 3 is a left, side view of structure 100, illustrating the start of a "folding" or "stowing" process to lower the overall height of structure 100, i.e., lower apex 102. Left gable wall 112 is shown being pushed, lowered, folded, rotated or otherwise stowed into an interior space of second story 106 above first story 104, rotating about the one or more hinges or hinge-like structures 210 mentioned previously. After left gable wall 112 has been stowed inside second story 106 via the one or more hinges or hinge-like structures 210, the right gable wall may then similarly be folded inside second story 106, lying on top of left gable wall 112. This leaves roof 200 supported by first story 104, in one embodiment, by a plurality of longitudinal slide arms (not shown) mounted to a top horizontal frame (not shown) of first story 104 and a plurality of associated mechanical stops or stoppers, respectively. More detail of these support structures will be provided later herein.

Figure 4:
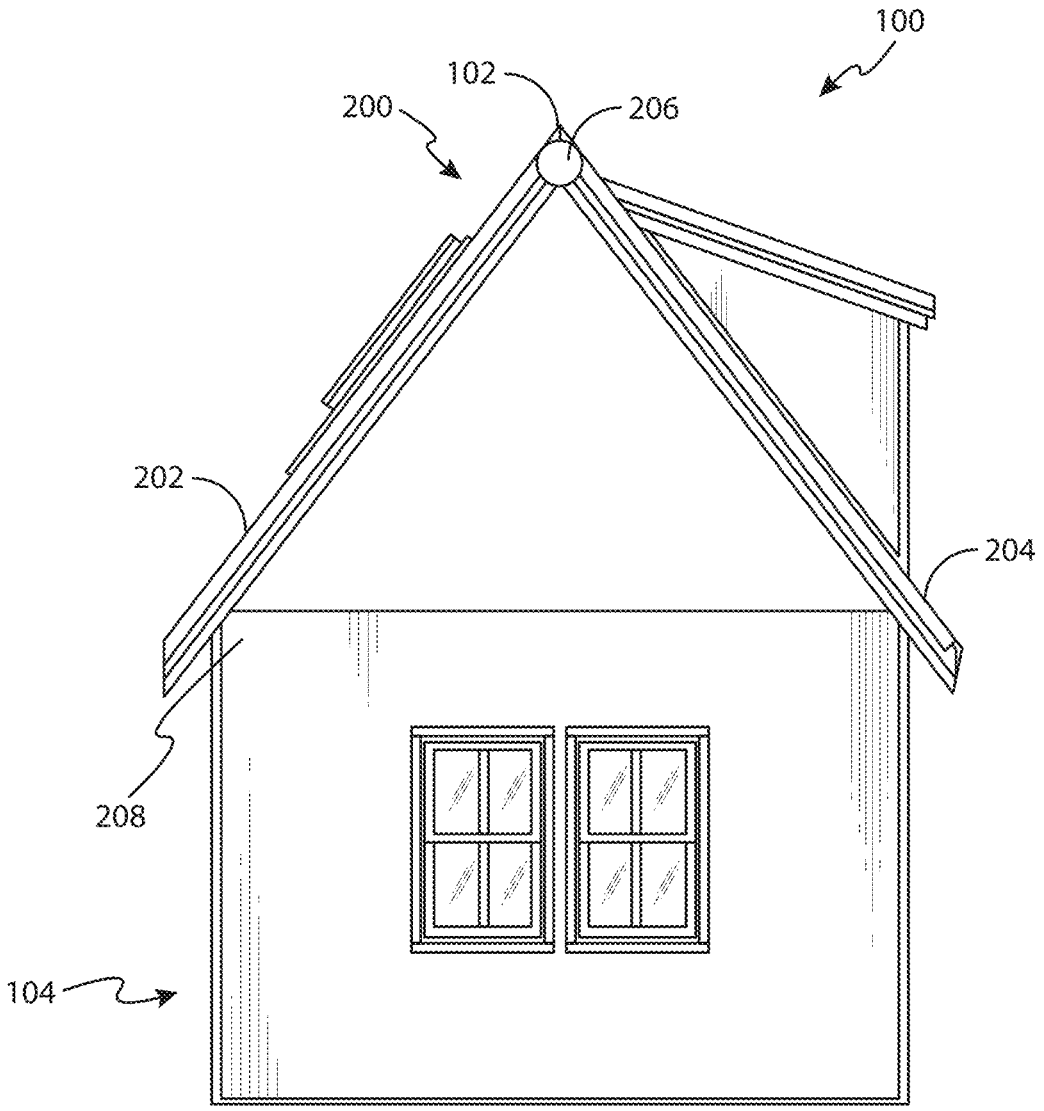
FIG. 4 is a left, side view of the foldable structure as shown in FIGS. 2 and 3, after both a left gable wall and a right gable wall have been folded down inside an upper portion of the structure.

FIG. 4 is a left, side view of foldable structure 100, after both left gable wall 112 and the right gable wall have been folded down inside second story 104. In this position, in one embodiment, roof 200 is supported by a plurality of longitudinal slide arms mounted to a top horizontal frame and associated stops located on roof panels 202 and 204.

Figure 5:
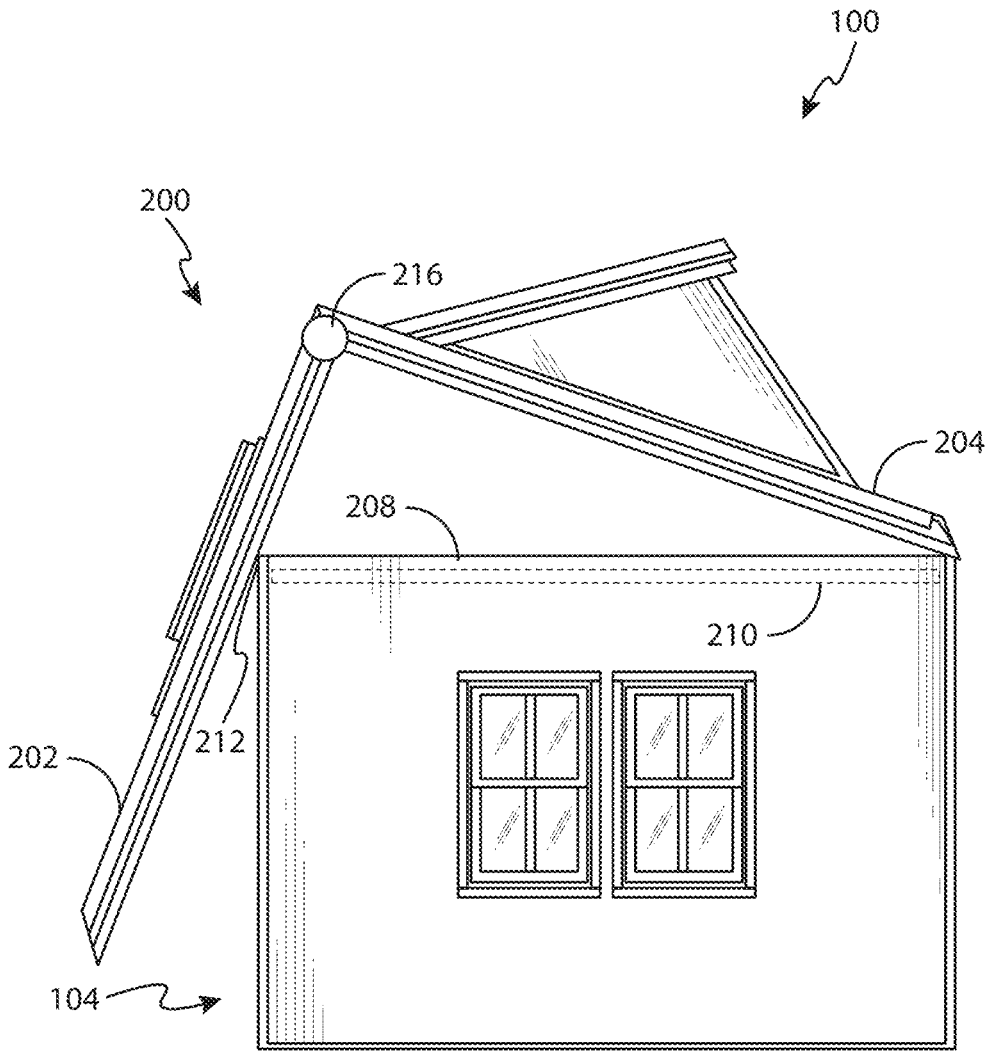
FIG. 5 is a left, side view of the foldable structure as shown in FIGS. 2-4, showing the roof being folded down to reduce the overall height of the structure.

FIG. 5 is a left, side view of structure 100, generally showing roof 200 being folded down to reduce the overall height of structure 100. In this embodiment, first roof panel 202 is released from one or more mechanical supports (not shown) and allowed to slide downwards against a length of structure 100 that defines a rear, top edge 212 of first story 104, as shown. In one embodiment, rear, top edge 212 of first story 104 comprises a beam of the top, horizontal frame, comprising a plurality of rotatable, pivot anchors (not shown in this view) attached thereto along the length of rear, top portion 212, which allows roof panel 202 to slide against a longitudinal slide arm of each pivot anchor and rotate clockwise, as shown.

As roof 200 is lowered, i.e., first roof panel 202 is released and lowered as shown in FIG. 5, roofline hinge 206 moves towards the left and downwards in this view, while second roof panel 204 rotates and slides over a length of structure 100 that defines a front, top edge 214 of first story 104, opposite of rear, top edge 212. In one embodiment, a plurality of rotatable pivot anchors are fastened along the length of a second beam of the top, horizontal frame, each pivot anchor comprising a longitudinal slide arm. Roof panel 204 slides over the longitudinal slide arms Each roof panel additionally rotates with respect to each other as provided by roofline hinge 206. As first roof panel 202 is lowered, second roof panel 204 becomes more and more parallel with the top horizontal frame until roof 200 is stowed, whereupon second roof panel 204 rests substantially horizontally over the first story 104.

Figure 6:
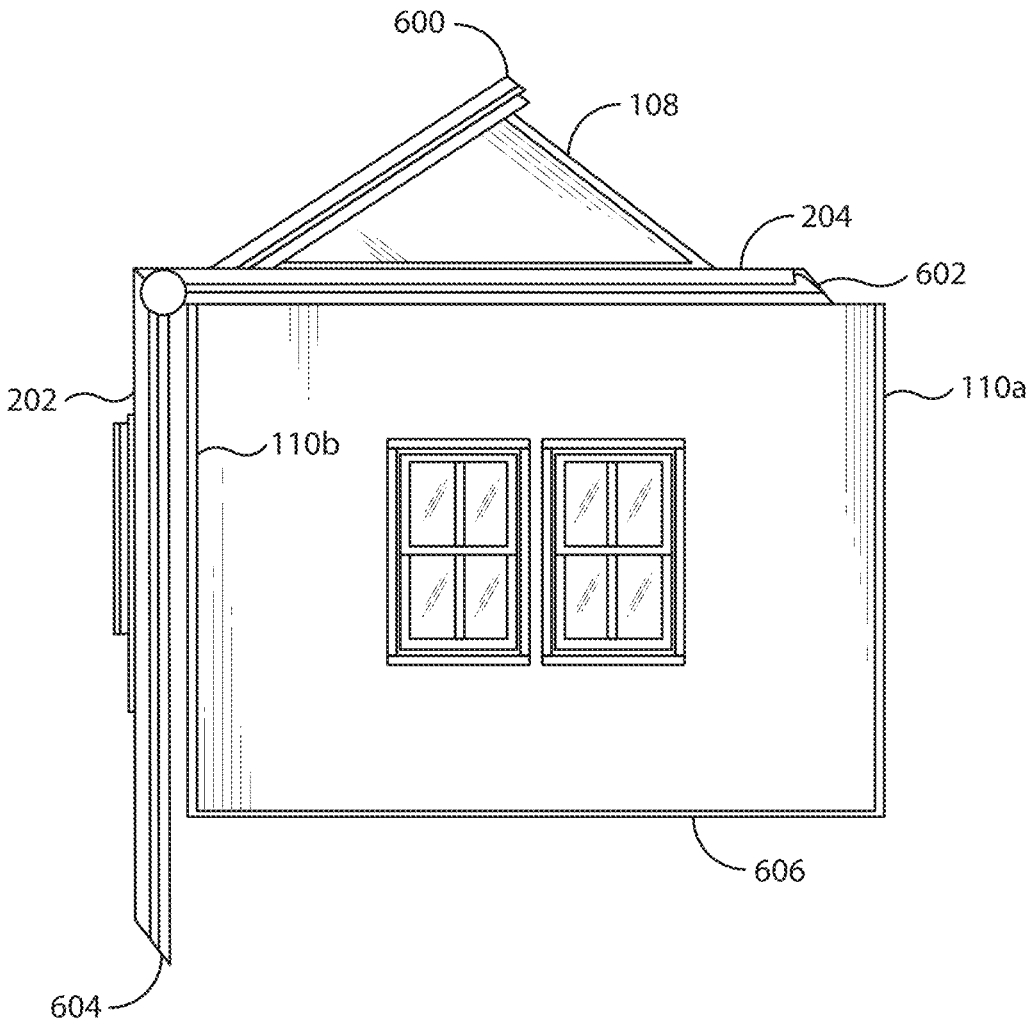
FIG. 6 is a left, side view of the foldable structure as shown in FIGS. 2-5 in a fully-stowed position.

FIG. 6 is a left, side view of foldable structure 100 in a fully-stowed position. In this position, the overall height of structure 100 has been lowered, now defined by the height of apex 600 of dormer 108. In an embodiment where dormer 108 is not present, the height of structure 100 would be the height of the top of second roof panel 204 from the ground. In this example, where the overall height of structure 100 prior to stowing is about 18 feet, and approximately 12 feet deep, apex 600 is about 11 feet from the ground, thus reducing the overall height of structure 100 from approximately 18 feet to approximately 11 feet. At this height, structure 100 may be transported from a production facility to a construction side over roads and highways, as the reduced height allows structure 100 to clear most overpasses and overhead municipal wiring. Note that in some embodiments, an edge 602 of second roof panel 204 may no longer overhang static wall 110*a*, as second roof panel 204 has been slid to the left as a result of stowing roof 200. It should be understood that although first roof panel 202 is shown abutting wall 110*b* and having edge 604 of first roof panel 202 extending past bottom 606 of structure 100, in another embodiment, first roof panel 202 may extend at an angle from wall 110*b*, with edge 604 of first roof panel 202 resting on a surface in-line with bottom 606 (i.e., on a transportation platform or the ground).

Figure 7:
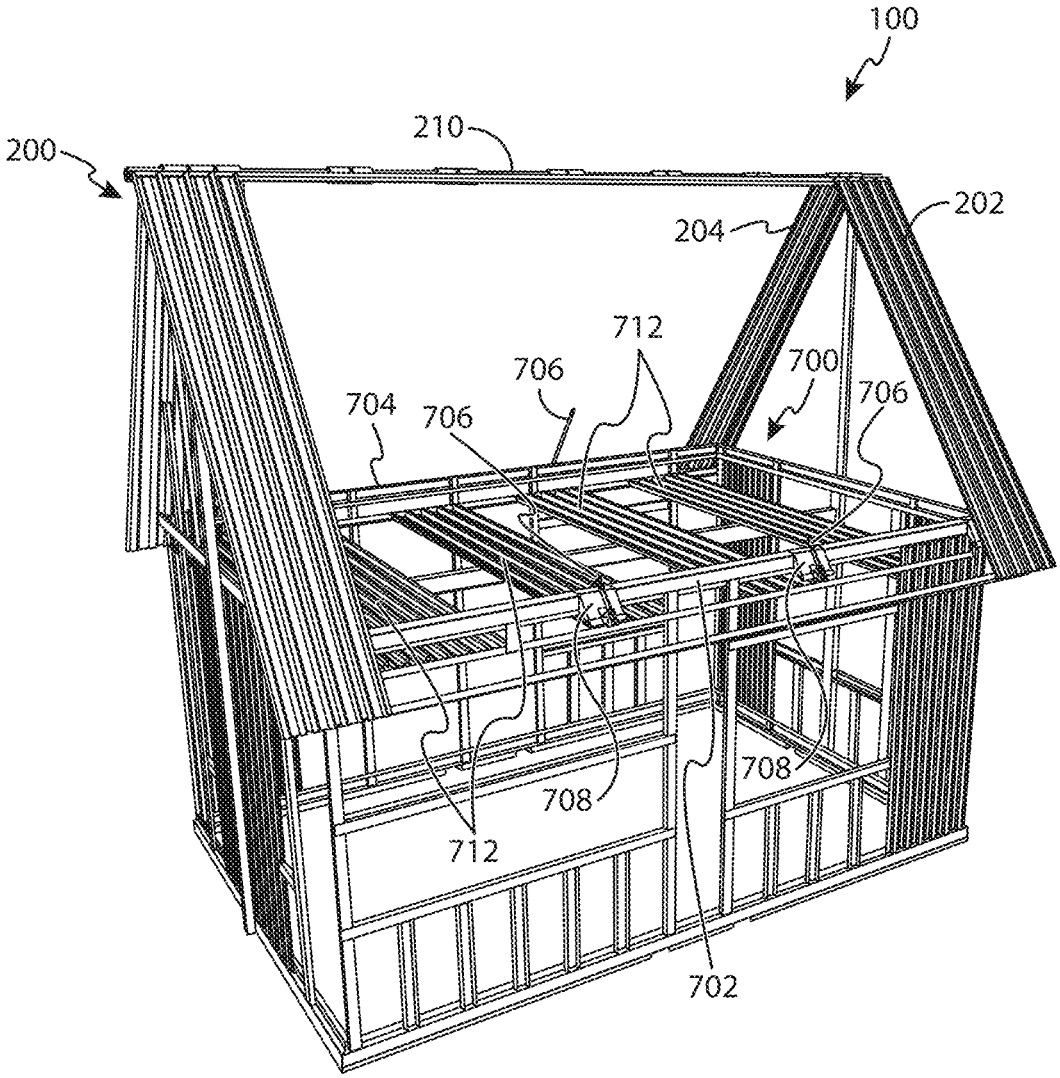
FIG. 7 is a perspective, cutaway view of one embodiment of the foldable structure, showing a portion of the roof, with the first roof panel and the second roof panel as shown in FIGS. 2-6 shown partially cut away, exposing a top horizontal frame.

FIG. 7 is a perspective, cutaway view of one embodiment of structure 100, showing a portion of roof 200, with first roof panel 202 and second roof panel 204 shown partially cut away, exposing top horizontal frame 700, which comprises first frame member 702 (comparable to rear, top edge 212) and opposing second frame member 704 (comparable to front, top edge 214). First roof panel 202 and second roof panel 204 are hingedly joined by roofline hinge 206. Left gable wall 112 and an opposing gable wall are not shown in this view. Also shown are portions of a floor 712 of second story 106. First story 104 is shown without interior or exterior walls, illustrating the frame of structure 100. As shown in FIG. 7, when stowing roof 200, first roof panel 202 slides and rotates over first frame member 702, towards the viewer and downwards, while second roof panel slides and rotates with respect to second frame member 704 to become substantially flat over first story 104.

First roof panel 202 is supported in part by two or more pivot anchors 708, each pivot anchor 708 comprising a longitudinal slide arm 706, each longitudinal slide arm 706 rotatably coupled to a respective pivot anchor 708. Although two pivot anchors 708 are shown coupled to first frame member 702 in FIG. 7, in other embodiments, a greater number of pivot anchors 708 may be used to support first roof panel 202. The longitudinal slide arms 706 are shown positioned at an angle, parallel with first roof panel 202 when roof 200 is in a deployed position. In practice, each of the longitudinal slide arms are slidably coupled to first roof panel 202, in one embodiment, captured within a respective channel formed within, or under, first roof panel 202, as will be shown in greater detail later herein. "Slidably coupled" means that first roof panel 202 may slide longitudinally against each slide arm while unable to be decoupled perpendicularly thereto.

Similarly, second roof panel 204 is supported by two or more pivot anchors 708 (hidden in this view, with only a single longitudinal slide arm 706 shown peaking above second member 704), each of the pivot anchors coupled to second frame member 704 and each comprising a longitudinal slide arm 706 rotatably coupled thereto. Again, two or more pivot anchors 708 and their respective longitudinal slide arms 706 may be used to support second roof panel 204. As with the previously-discussed longitudinal slide arms 706 along first frame member 702, the longitudinal slide arms coupled to second frame member 704 are positioned at an angle, parallel with second roof panel 204, when roof 200 is in a deployed position. Each of the longitudinal slide arms of the pivot anchors 708 mounted to second frame member 704 used to support second roof panel 204 are slidably coupled to second roof panel 204, in one embodiment, captured within a respective channel formed within, or under, second roof panel 204, as will be shown in greater detail later herein.

When it is desired to stow roof 200, roof panel 202 is disconnected from one or more mechanical supports (not shown) at or near first frame member 702 that prevent roof 200 from folding to a stowed position. For example, a plurality of mechanical stops may be coupled to roof panel 202 that interfere with a plurality of longitudinal slide arms 706, respectively. In one embodiment, the mechanical stops are removed, allowing roof panel 202 to slide over the plurality of longitudinal slide arms 706, causing cave 714 to be lowered towards the ground.

Figure 8:
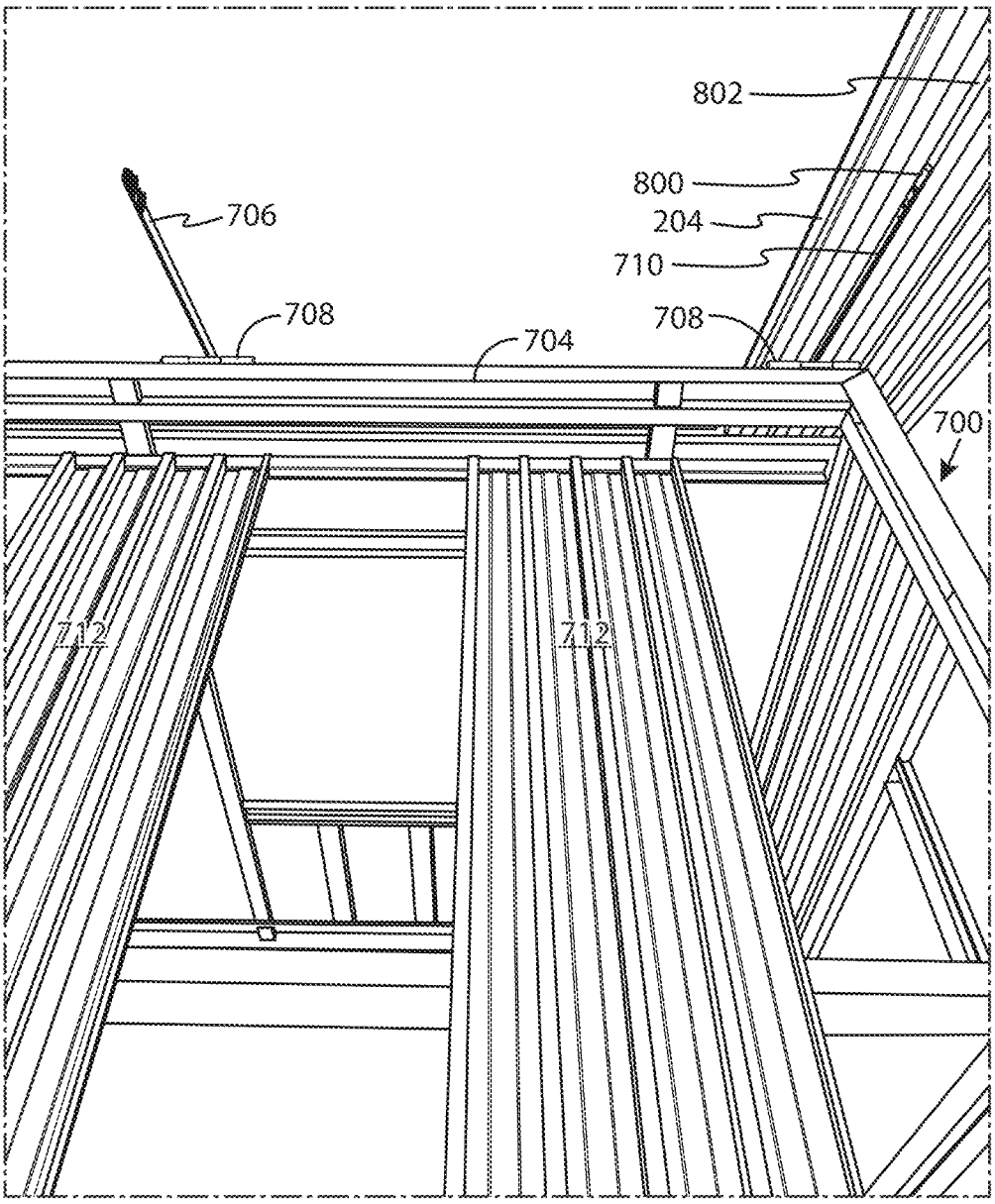
FIG. 8 is a top, three-quarter, perspective, cutaway view of a portion of a second story of the foldable structure as shown in FIG. 7, highlighting an interaction among a mechanical stop, a channel formed in the second roof panel and one of plurality of longitudinal slide arms rotatably coupled to a respective pivot anchor.

FIG. 8 is a top, three-quarter, perspective, cutaway view of a portion of second story 106 as shown in FIG. 7, highlighting an interaction among a mechanical stop 800, a channel 802 formed in second roof panel 204 and one of the longitudinal slide arms 706 rotatably coupled to a respective pivot anchor 1102 (two of such longitudinal slide arms and pivot anchors shown). Pivot anchor 1102 is similar to pivot anchor 708 and will be explained in detail later herein.

Mechanical stop 800 may comprise a solid object, such as a piece of metal, wood, plastic, etc. able to withstand the force of gravity pulling downwards on second roof panel 204 against the end of longitudinal slide arm 706. Mechanical stop 800 may be sized and shaped to fit within channel 802. Channel 802 may comprise a natural deformation within second roof panel 204 running transversely, i.e., from near the caves towards the roofline, such as in the case shown, where second roof panel 204 comprises one or more corrugated metal sheets. In other embodiments, channel 802 may be particularly formed into, or onto, second roof panel 204, such as in the case where second roof panel 204 is formed into a smooth or semi-smooth material having a certain thickness, or onto an underside surface of second roof panel 204 in the form of a guide rail or the like.

In FIG. 8, mechanical stop 800 is shown fixed within channel 802, such as by bolting, riveting, welding, etc., abutting one end of longitudinal slide arm 706 after second roof panel 204 comes to rest during deployment of roof 200. During deployment, i.e., erecting roof 200 from a stowed position (as shown in FIG. 6), longitudinal slide arm 706 slides within channel 802 as second roof panel 204 is rotated into place, i.e., as roof 200 is lifted into the fully-deployed position, as shown in FIGS. 1-4. Second roof panel 204 is prevented from sliding further downwards as a result of mechanical stop 800 encountering the end of longitudinal slide arm 706. Second roof panel 204 is still permitted to rotate about an imaginary axis 804 formed longitudinally though the pivot anchors 708 until roof 200 is fully deployed.

It should be understood that two or more respective combinations of mechanical stops 800, longitudinal slide arms 706 and channels 800 are used to support second roof panel 204 and to allow second roof panel 204 to slide and rotate as needed in order to stow or deploy roof 200.

Figure 9:
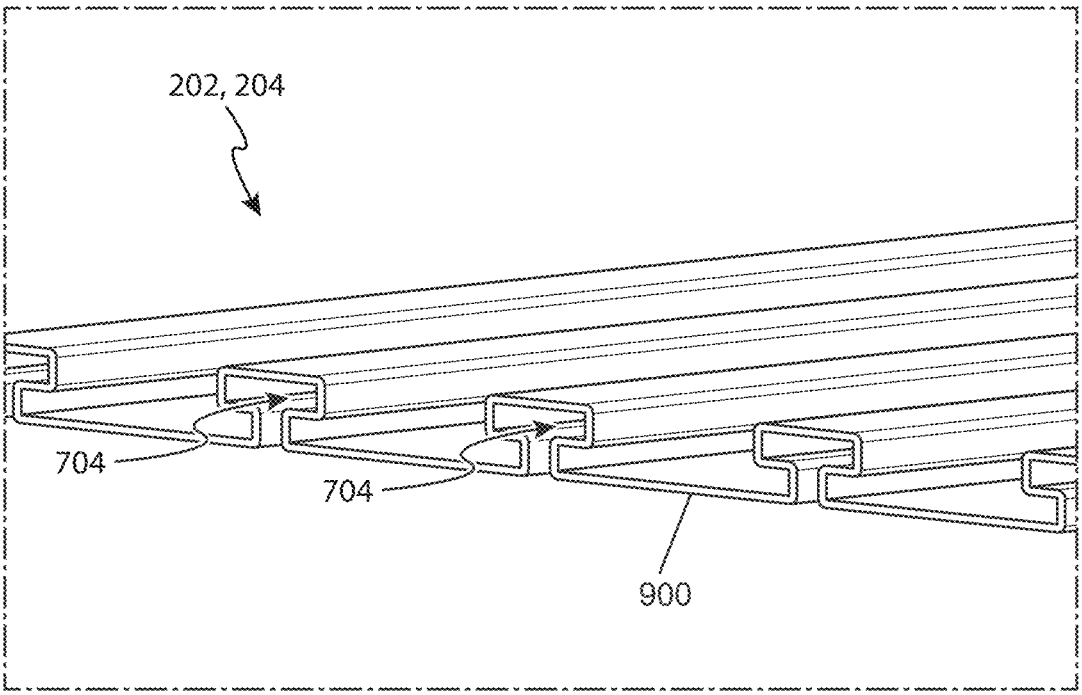
FIG. 9 is a perspective, edge view of one embodiment of either the first roof panel or the second roof panel as shown in FIGS. 1-8, highlighting a raised channel extending upwardly.

FIG. 9 is a perspective, edge view of one embodiment of either first roof panel 202 or second roof panel 204, highlighting a raised channel 802 extending from cave to ridge line. In this embodiment, the roof panel is formed of one or more sheets of steel or some other thin, hard material having a plurality of channels 802 formed from the roof panel itself. In some embodiments, an under surface 900 of roof panel 202 or 204, visible to occupants inside second story 106, may be configured with an atheistically-pleasing material, such as plank paneling, wainscoting, or simply paint. This may save time and money by eliminating the need to install interior ceilings in second story 106.

In the example shown in FIG. 9, the steel or other material of roof panel 202 and 204 is thin enough to be folded by a mechanical press to form the channels. In this embodiment, each channel is formed transversely into the panel, running in a direction from cave 900 to the ridgeline 116. In some embodiments, each channel 802 need not span the entire length from cave to ridgeline, especially near the ridgeline, as movement of either first roof panel 202 or second roof panel 204 is typically limited to just a few feet during deployment and stowage. In the embodiment shown in FIG. 9, channels 802 are each wider at a raised portion of each channel 802 such that a longitudinal slide arm 706 is not able to escape channel 802 by a sheer force, but is rather captured within channel 802 and allowed to slide therein. It should be understood that the shape, size and spacing of channels in other embodiments could be different than what is shown in FIG. 9. Also, it should be understood that in some embodiments, no channels are used, and longitudinal slide arms simply slide against the underside of each roof panel. In still further embodiments, channel 802 may protrude downwards, and that in some embodiments, channel 802 does not provide for capturing longitudinal slide arms therein.

Figure 10:
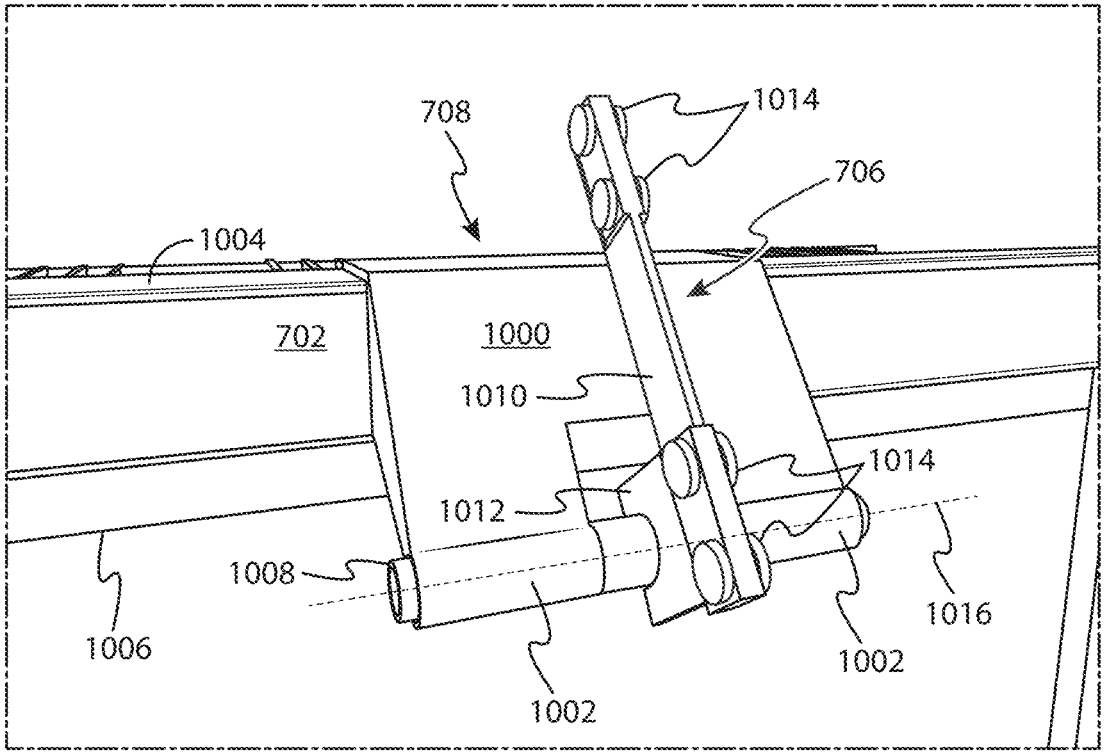
FIG. 10 is a close-up, perspective view of one embodiment of one of the pivot anchors as shown in FIG. 8 coupled to a first member of the top horizontal frame as shown in FIG. 7.

FIG. 10 is a close-up, perspective view of one embodiment of one of the pivot anchors 708 coupled to first member 702 of top horizontal frame 700, as shown in FIGS. 7 and 8. In this embodiment, pivot anchor 708 comprises flange 1000 and a pair of tubes 1002 in axial alignment with each other, as shown. In this embodiment, tube 1002 is lower than a top surface 1004 of first member 702 and also at or lower than a lower surface 1006 of first member 702, as well as being offset from static wall 110 This arrangement may aid first roof panel 202 during the deployment and stowing processes, because this allows each of the tubes 1002 to extend away from static wall 110 of first story 104, thereby allowing roof panel 702 to be lowered towards the ground without interference from any exterior finishes on wall 110, or any protrusions of any window or door trim.

Longitudinal slide arm 706 is shown comprising arm 1010 coupled to plate 1012, which is in turn coupled to tube 1008. Tube 1008 is a hollow or solid cylinder that resides inside tubes 1002, allowed to rotate therein. In a different embodiment, tubes 1002 may reside inside tube 1008. In any case, longitudinal slide arm 706 is permitted to rotate about an imaginary axis 1016 running longitudinally through tube 1008/tubes 1002 while roof 200 is being stowed or deployed. In some embodiments, one or more rollers 1014 may be located on arm 1010 in order to help a roof panel to slide along longitudinal arm 706 more easily.

Figure 11:
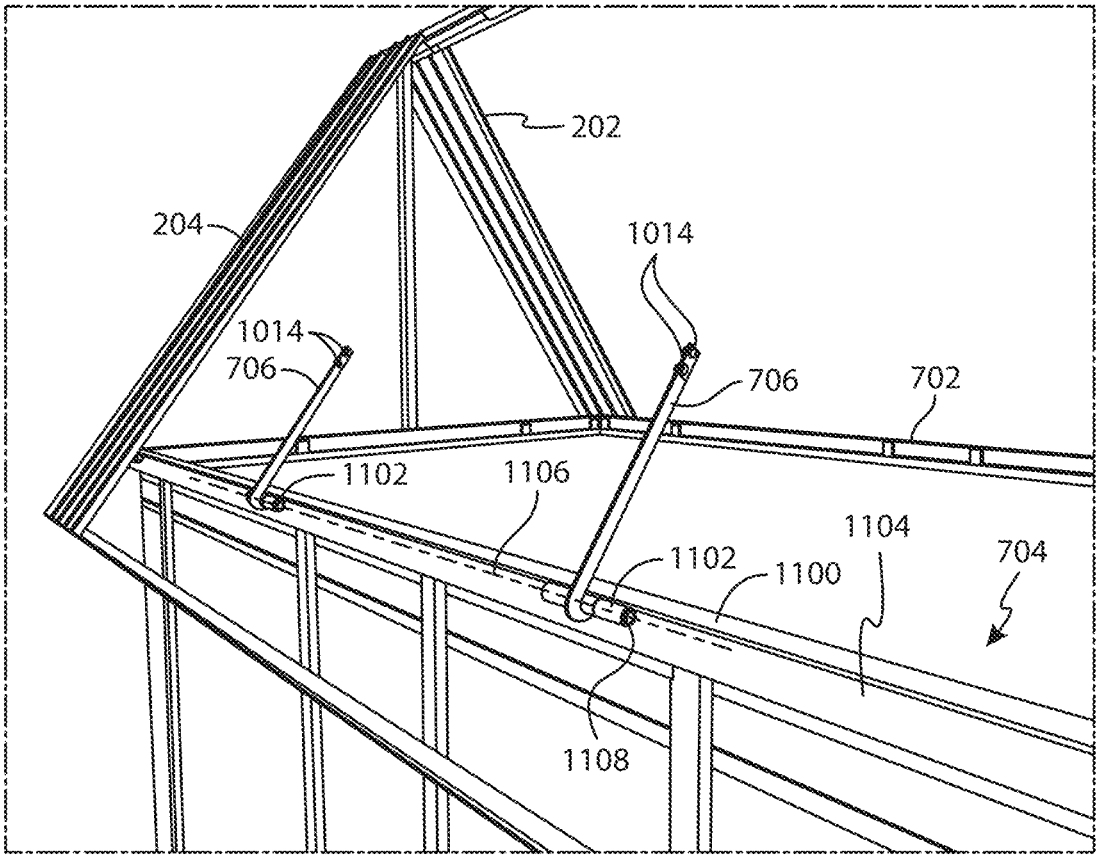
FIG. 11 is a perspective, opposing, cutaway view of the foldable structure from the view shown in FIG. 7 showing two longitudinal slide arms positioned at an angle to a second frame member of the top horizontal frame as shown in FIG. 7 when the roof is in a deployed state.

FIG. 11 is a perspective, opposing, cutaway view of structure 100 from the view shown in FIG. 7. In this view, opposing second frame member 704 is closest to the viewer. Shown is a portion of roof 200, with first panel 202 and second panel 204 shown mostly cut away, with opposing second frame member 704 shown in foreground and first frame member 702 shown in the background.

FIG. 11 additionally shows two longitudinal slide arms 706 as part of two pivot anchors 1102 mounted along a length of second frame member 704. Each of the longitudinal slide arms 706 are positioned at an angle to second frame member 704 when roof 200 is in a deployed state, i.e., second roof panel 204 and first roof panel 202 are positioned to form apex 102. In this position, an angle formed between first roof panel 202 and second roof panel 204 is most acute, from between approximately 135 degrees (for a relatively low-pitched roof 200) to approximately 30 degrees (for a relatively high-pitched roof 200). In the positions shown in FIG. 11, each longitudinal slide arm 706 is positioned at about a 50 degree angle from a top surface 1100 of opposing second frame member 704. Each longitudinal slide arm 706 may comprise one or more rollers 1014 in order to aid second roof panel 204 to slide more easily along each longitudinal slide arm 706 while second roof panel 204 moves longitudinally with respect to each longitudinal slide arm 706 during deployment or stowage of roof 200.

Each of the longitudinal slide arms 706 are rotatably attached to a respective, fixed pivot anchor 1102, shown in this embodiment as a tubular structure affixed to an outer side surface 1104 of second frame member 704. Each slide arm 706 is rotatably attached to pivot anchor 1102 via a solid or hollow tube 1108 that is coupled to each slide arm 706. Tube 1108 rotates within pivot anchor 1102. Thus, each of the longitudinal slide arms 706 are able to rotate about an imaginary, axial axis 804 formed longitudinally through pivot anchor 1102 as roof 200 is raised and lowered.

In this embodiment, pivot anchor 1102 is affixed to outer side surface 1104 such that its top is even, or approximately even, with top surface 1100 of opposing second frame member 704. This mounting arrangement is different than how tube 1002 is positioned lower than top surface 1004, and in one embodiment, lower surface 1006 of first frame member 702. By mounting the top of pivot anchor 1102 substantially even with top surface 1100, second roof panel 204 is able to lie flat or substantially flat over first story 104 when roof 200 is in the stowed position. Otherwise, second roof panel 204 would not be capable of lying substantially flat.

Figure 12:
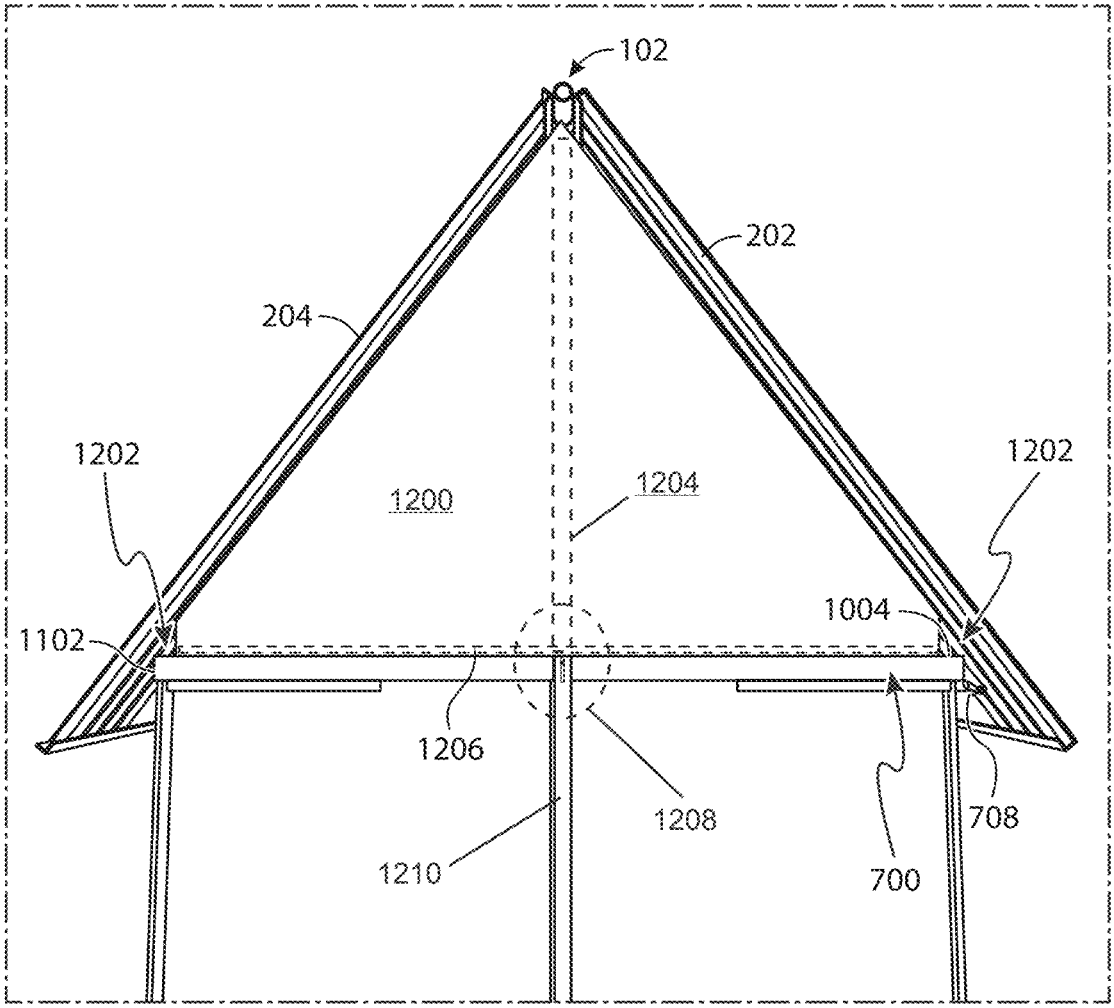
FIG. 12 is a right, plan, partially-cutaway view of a portion of the foldable structure, featuring details of a second story of the foldable structure.

FIG. 12 is a right, plan, partially-cutaway view of a portion of structure 100, featuring details of second story 106. Right gable wall 1200, opposite of left gable wall 112, is shown, comprising a triangular structure having, in this particular embodiment, each lower corner 1202 truncated as shown. Truncation of each lower corner 1202 may be advantageous in some embodiments, because it creates more space for each roof panel to slide without interfering with each folded-down gable wall. Right gable wall 1200 comprises one or more hinges or hinge-like structures 210 (such as a tough, flexible material able to affix a lower edge 1206 of right gable wall 1200 to either top horizontal frame 700 or floor 712 of second story 106). Hinge(s) 210 (shown mounted inside second story 106 in dashed lines), allow right gable wall 1200 to be rotated about hinge(s) 210 and laid down into a space over first story 104 during stowage of roof 200, and to allow right gable wall 1200 to be rotated back into place during deployment of roof 200. Left gable wall 112 is similarly configured.

FIG. 12 also more clearly shows how a pivot anchor 708 located on first frame member 702 is mounted lower than a top surface 1004 and bottom surface 1006 of top horizontal frame 700, allowing first roof panel 202 to be lowered to the side of structure 100, while a pivot anchor 1102 located on second frame member 704 is shown mounted substantially even with a top surface 1100 of top horizontal frame 700, thus allowing second roof panel 204 to lie substantially horizontally over first story 104 when roof 200 is stowed.

FIG. 12 additionally illustrates an embodiment where structural reinforcement is introduced, in the form of a configurable reinforcement means 1208. This structural reinforcement may be used in embodiments where structure 100 relatively tall and the gable walls are large in surface area. As a result, wind seismic activity may exert lateral loads on structure 100 acting sideways the gable walls. The structural reinforcement described herein is designed to resist these kinds of lateral loads, while at the same time being configurable in order to allow the gable walls to fold inwards during transport.

In this embodiment, upper vertical post 1204 is part of gable wall 1200 and abutting and in substantial longitudinal alignment with a lower vertical post 1210 of a lower, static wall 110 (cut away in this view) of structure 100 via configurable reinforcement means 1208. "Configurably coupled" means that configurable reinforcement means 1208 can be placed in a first position, joining upper vertical post 1204 with lower vertical post 1210, and into a second position, thereby allowing upper vertical post 1204 to pivot with respect to lower vertical post 1210 the gable walls are folded inside structure 100 prior to transport. Further details of configurable reinforcement means 1208 is described later herein.

Figure 13:
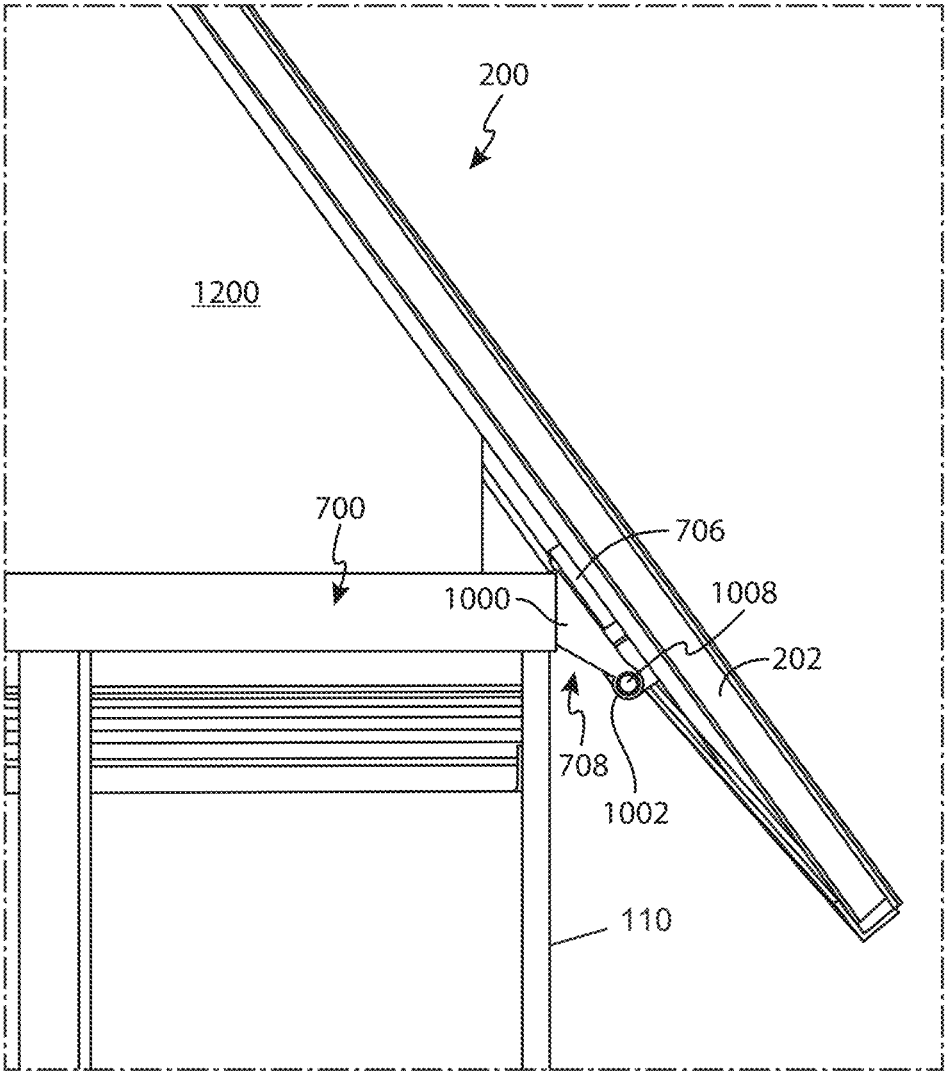
FIG. 13 is a right, plan, partially-cutaway view of a portion of the foldable structure, featuring how the first roof panel interacts with one of the longitudinal slide arms mounted to first frame member via a pivot anchor.

FIG. 13 is a right, plan, partially-cutaway view of a portion of structure 100, featuring how first roof panel 202 interacts with one of the longitudinal slide arms 706 mounted to first frame member 702 via one of the pivot anchors 708. As shown, roof 200 is in the deployed position, and longitudinal slide arm 706 is in contact with first roof panel 202 via a channel 802 (hidden in this view). In this embodiment, longitudinal slide arm 706 rests against flange 1000 of pivot anchor 708 for supporting first roof panel 202.

In the view shown, tube 1002 is clearly shown attached to, or formed with, flange 1000, while tube 1008 resides inside tube 1002. Flange 1000 is configured to extend tube 1000 horizontally away from wall 110 in order for roof panel 702 to clear any protrusions from wall 110, such as various external wall coverings or door/window trim as roof panel 702 is lowered towards the ground. As first roof panel 202 is lowered during the stowing process, tube 1008 is able to rotate with respect to tube 1002, thus allowing longitudinal slide arm 706 to rotate clockwise, as shown in FIG. 13, allowing first roof panel 202 to be lowered downwards and to the side of structure 100, as shown in FIG. 6. Longitudinal slide arm 706 typically remains in contact with first roof panel 202 at all times.

Figure 14:
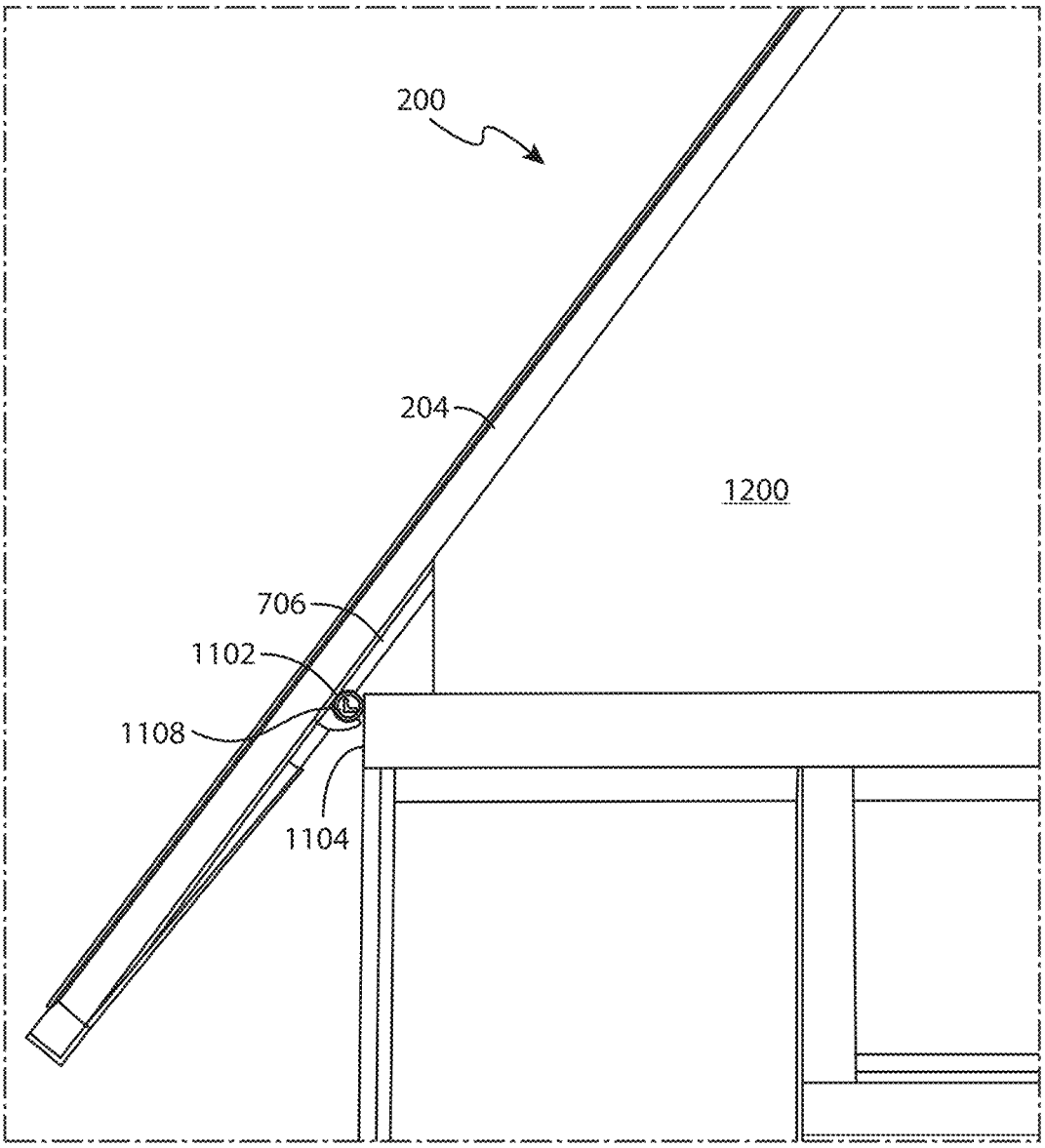
FIG. 14 is a left, plan, partially-cutaway view of a portion of the foldable structure, featuring how the second roof panel interacts with one of the longitudinal slide arms mounted to a second frame member via a pivot anchor.

FIG. 14 is a left, plan, partially-cutaway view of a portion of structure 100, featuring how second roof panel 204 interacts with one of the longitudinal slide arms 706 mounted to second frame member 704 via pivot anchor 1102. As shown, roof 200 is in the deployed position, and longitudinal slide arm 706 is in contact with second roof panel 204 via a channel 802 (hidden in this view).

In the view shown, pivot anchor 1002 is clearly shown comprising a tube attached to outer side surface 1104 of second frame member 704, while tube 1108 resides inside the tube of pivot anchor 1102. As second roof panel 204 is lowered during the stowing process, tube 1108 is able to rotate within the tube of pivot anchor 1102, thus allowing longitudinal slide arm 706 to rotate clockwise, as shown in FIG. 14, allowing second roof panel 204 to slide along longitudinal slide arm 706 and rotate about axis 806 while being lowered over first story 104. Longitudinal slide arm 706 typically remains in contact with second roof panel 204 at all times.

Figure 15:
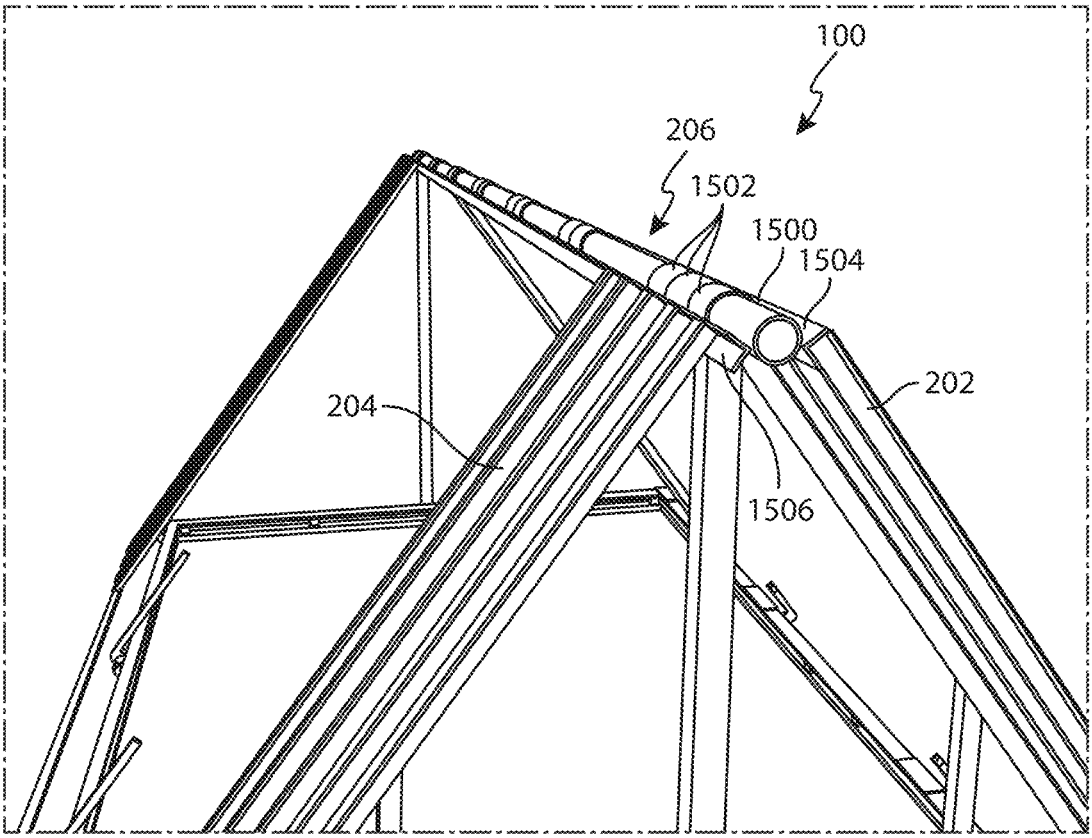
FIG. 15 is a perspective, cutaway view of a portion of the foldable structure, highlighting a roofline hinge.

FIG. 15 is a perspective, cutaway view of a portion of structure 100, highlighting roofline hinge 206. In this embodiment, roofline hinge 206 comprises a hollow or solid main tube 1500 inserted through one or more hollow couplings 1502. In other embodiments, ridgeline hinge could comprise one or more butt hinges.

Each of the hollow couplings 1502 is coupled to either a first longitudinal L-bracket 1504 or to a second longitudinal L-shaped bracket 1506, each L-bracket spanning approximately a length of roofline 116 of structure 100. In one embodiment, a plurality of short couplings 1502 are used, such as 10 or more, and the L-shaped brackets are coupled alternatively to each respective L-bracket. The arrangement of components as shown allows first roof panel 202 and second roof panel 204 to independently rotate with respect to main tube 1500 and each other and, thus, allow roof 200 to be stowed and deployed.

Figure 16A:
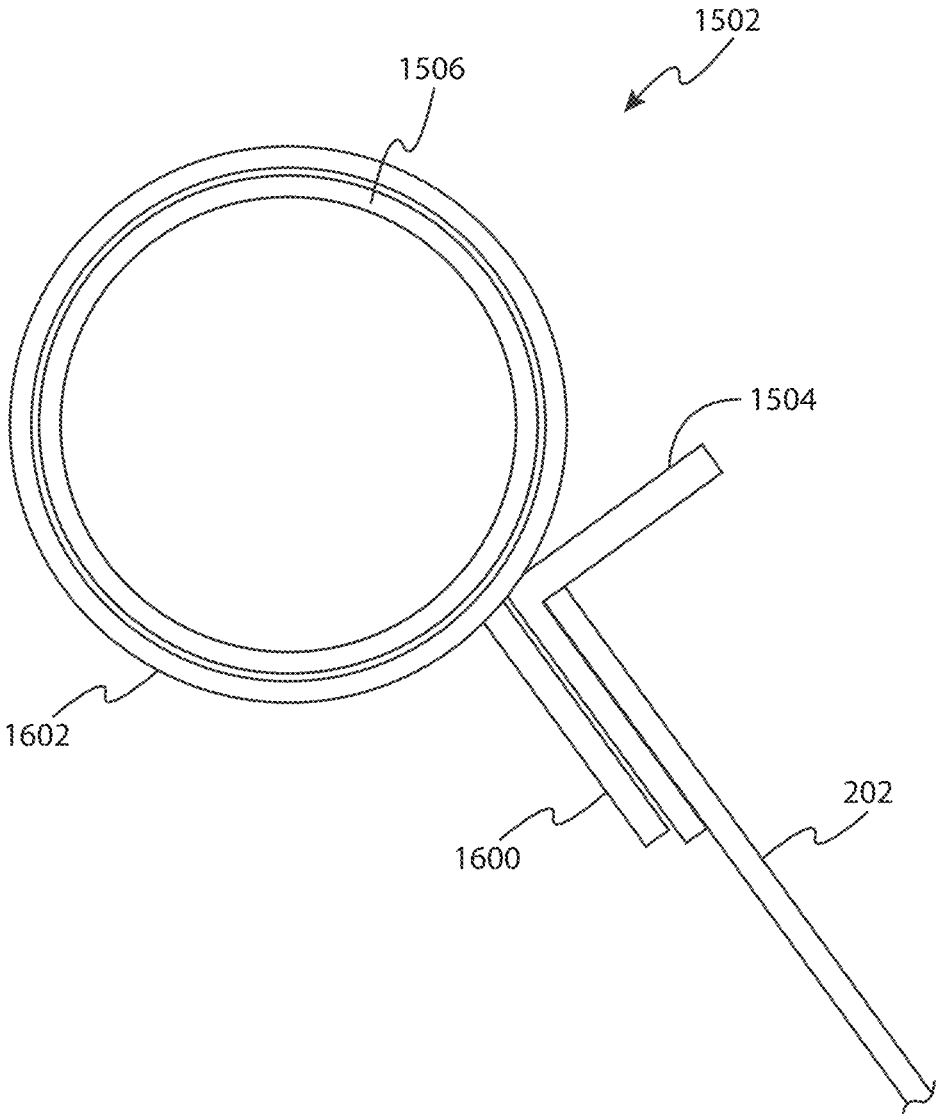
FIG. 16A is a side, plan view of a hollow coupling from the same perspective as shown in FIG. 15.

FIG. 16A is a side, plan view of hollow coupling 1502 from the same perspective as shown in FIG. 15, with main tube 1500 shown inserted therein, and longitudinal L-bracket 1504 attached to hollow coupling 1502 via a support arm 1600 extending from surface 1602 of hollow coupling 1502 as shown. First roof panel 202 is shown coupled to longitudinal L-bracket 1504. It should be understood that the relative thickness of each component shown in FIG. 16A may not be shown in proportion to each other, and that gaps are shown between some of the components in order to better illustrate the components while, in practice, gaps are typically not present.

Figure 16B:
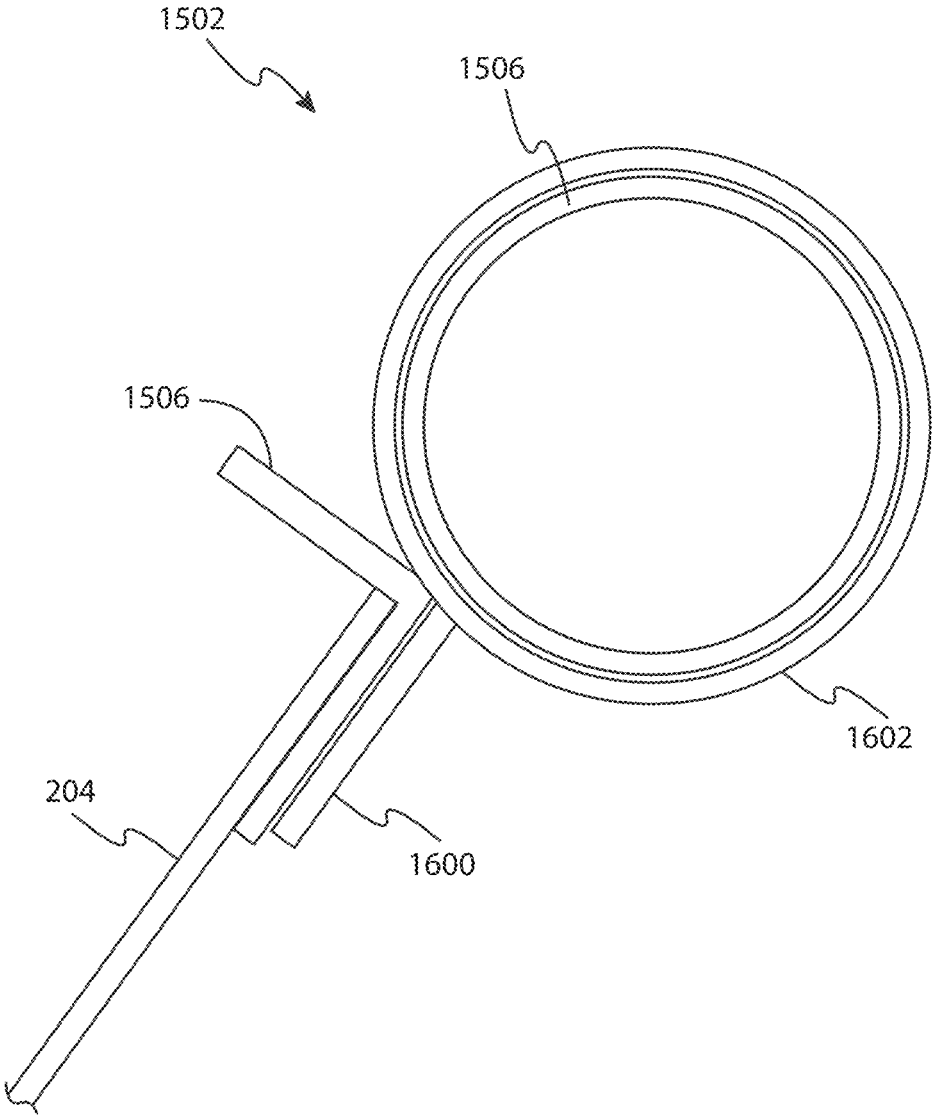
FIG. 16B is a reverse, side, plan view of the hollow coupling as shown in FIG. 16A.

Support arm 1600 is configured to support longitudinal L-bracket 1504, and may extend from surface 1602 by 1 inch or more, running approximately the length of hollow coupling 1502, in one embodiment, 4 inches long and 4 inches in diameter, with main tube 1500 approximately 3½ inches in diameter. In one embodiment, support arm is welded to surface 1602, but in other embodiments, other techniques may be used, including forming hollow coupling 1502 of a unified structure. In one embodiment, a plurality of hollow couplings 1502 are inserted onto main tube 1500, alternatively reversing the direction of each coupling as they are placed onto main tube 1500 (i.e., appearing as in FIG. 16B). In this way, alternating hollow couplings support either first longitudinal L-bracket 1504 and first roof panel 202 or second longitudinal L-shaped bracket 1506 and second roof panel 204. In other embodiments, groupings of two or more hollow couplings may be placed onto main tube 1500 in the same orientation, then reversing orientation for the next grouping.

Figure 17:
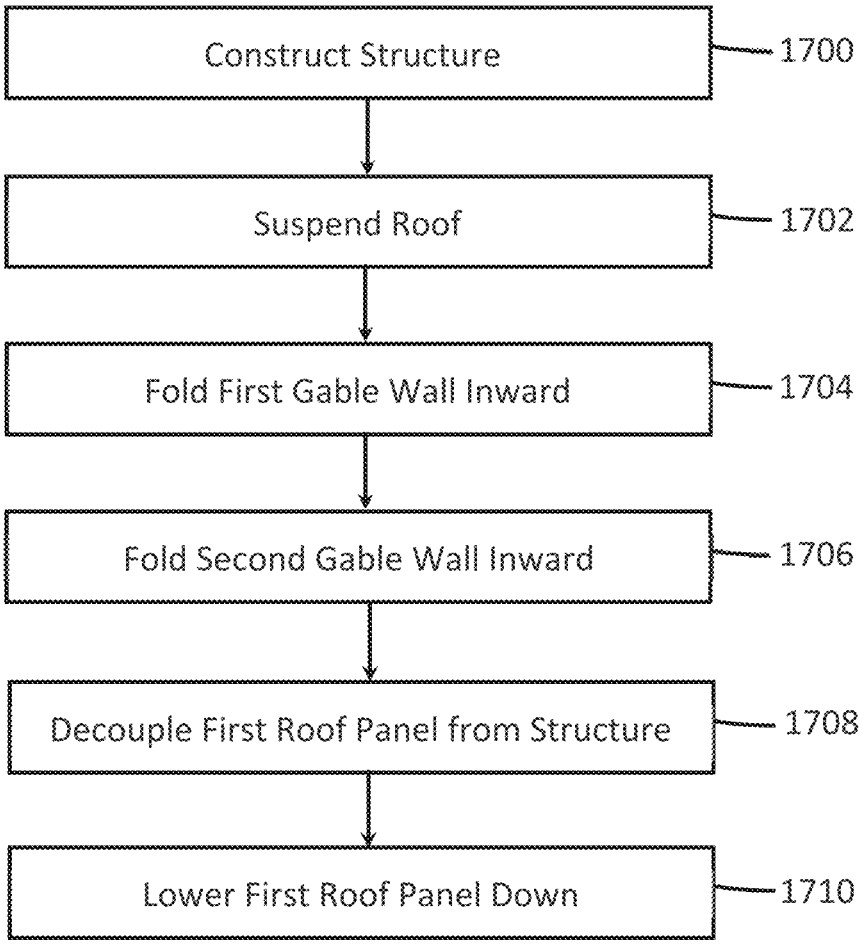
FIG. 17 is a flow chart illustrating one embodiment of a method for stowing the structure.

FIG. 17 is a flow chart illustrating one embodiment of a method for stowing structure 100. The method describes steps needed to stow roof 200 from a deployed position, meaning that apex 102 is at its highest point during normal occupancy of structure 100, and first roof panel 202 and second roof panel 204 are in a fixed relationship with each other. It should be understood that in some embodiments, not all of the method steps shown in FIG. 17 are performed, and that the order in which the steps are performed may be different in other embodiments.

At step 1700, structure 100 is typically built at an off-site location, i.e., not in a location where structure 100 will permanently be placed, such as a warehouse, factory or open-air facility. For example, structure 100 is as shown in at least FIGS. 1 and 2.

At step 1702, roof 200 is temporarily supported so that it does not collapse when left gable wall 112 and right gable wall 1200 are folded inward over first story 104. Support may be achieved by placing a plurality of supports, such as wooden beams, underneath a length of an cave of first roof panel 202, attaching one or more points of roofline 116/apex 102 to a crane, or some other method.

At step 1704, left gable wall 112 is folded down and over first story 104. In some embodiments, left gable wall 112 is folded onto floor 712 of second story 106. This may first require removal of one or more mechanical fasteners that are typically used to secure left and right gable walls 112 in place. A lower edge 208 of left gable wall 112 is coupled via one or more hinges or hinge-like structures 210 to top horizontal frame 700 of first story 104 or to some other portion of structure 100, such as floor 712. In other embodiments, lower edge 208 may be coupled via one or more hinges to another part of structure 100, different from top horizontal frame 700, such as to floor 712 of second story 106 that is coupled to top horizontal frame 700.

At step 1706, right gable wall 1200 is similarly folded into the space over first story 104, on top of left gable wall 112. This may first require removal of one or more mechanical fasteners that are typically used to keep right gable wall 1200 in place. Similar to left gable wall 112, right gable wall 1200 comprises a lower edge 1206, coupled via one or more hinges or hinge-like structures to top horizontal frame 700 of first story 104. In other embodiments, lower edge 1206 may be coupled via one or more hinges to another part of structure 100, different from top horizontal frame 700, such as to floor 712 of second story 106 that is coupled to top horizontal frame 700.

At step 1708, first roof panel 202 is mechanically uncoupled from the rest of structure 100 so that roof 200 may be stowed after the support as described in step 1700 is removed. In one embodiment, mechanical interference between first roof panel 202 and a plurality of longitudinal slide arms 706 supporting first roof panel 202 is removed. In one embodiment, a plurality of mechanical stops 800 are removed from a plurality of channels 802 formed into, or on, first roof panel 202, respectively. In another embodiment, mechanical interference between first roof panel 202 and first member 702, or some other fixed mechanical component of structure 100, is removed. For example, first roof panel may be screwed or bolted to a plurality of flanges 1000 spaced along first member 702 or directly to first member 702.

At step 1710, once the mechanical interference between first roof panel 202 and, in one embodiment, the plurality of longitudinal slide arms 706 is removed, cave 714 of first roof panel 202 is lowered downwards towards the ground and to the side of structure 100 as shown in FIG. 6, either by removing supports that uphold first roof panel 202 and lowering by people or by crane, etc. In one embodiment, as roof 200 is lowered, first roof panel 202 slides downwards against a plurality of longitudinal slide arms 706, rotating about axis 1016 as it is lowered to the side of structure 100. In addition, during the lowering process, second roof panel 204 slides along a plurality of longitudinal slide arms 706 and rotates about an imaginary axis 804 located longitudinally through tube 1108 of a plurality of pivot anchors 1102 coupled to outer side surface 1104 of second frame member 704. After the stowing process has been completed, second roof panel 204 lies over second floor 106 as shown in FIG. 6. In this stowed position, the overall height of structure 100 has been lowered significantly, enabling structure 100 to be loaded onto a truck for transport on municipal streets to a permanent location.

The method of FIG. 17 is generally reversed when deploying roof 200, for example, after structure 100 reaches a permanent location.

Figure 18:
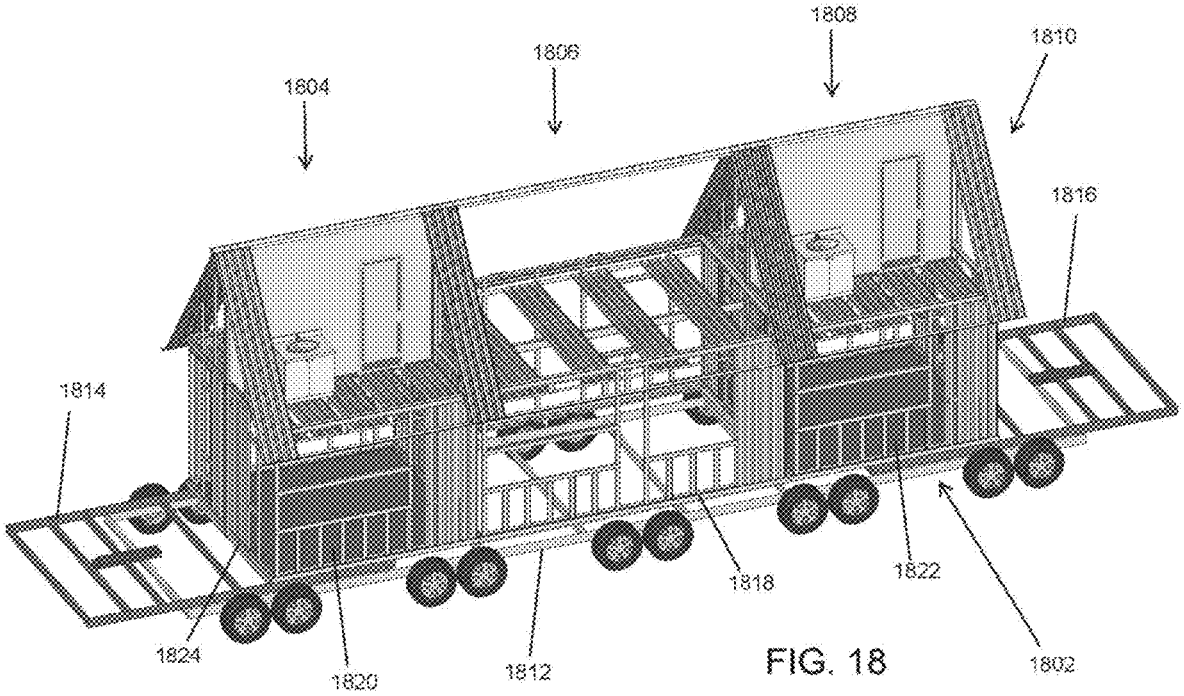
FIG. 18 is a perspective view of one embodiment of another modular structure, configured to be quickly and easily stowed for transport over public streets and highways.

FIG. 18 is a perspective view of one embodiment of a modular structure 1800, configured to be quickly and easily stowed for transport over public streets and highways. In this embodiment, "stowed" means at least one portion of structure 1800 being rotatable, i.e., able to be laid down on its side in order to reduce its height. Some portions of structure 1800 are shown in cutaway view, such as the roofs and some walls.

Structure 1800 is shown comprising three modular substructures, end substructure 1804, middle substructure 1806, and end substructure 1808. Although structure 1800, in this embodiment, comprises two end substructures and a middle substructure, in other embodiments, other arrangements are contemplated. For example, in one embodiment, structure 1800 comprises only one end substructure and one middle substructure.

Each of the substructures shown in FIG. 18 may be prefabricated at a factory and placed on trailer 1802 for transport to a job site. Prefabrication may include construction of walls, windows, doors, tile, carpeting, installation of cabinets, toilets, showers, bathtubs, and electrical. However, at the factory, each of the substructures are separate units from each other, unconnected by any electrical wiring or plumbing. In other embodiments, some or all electrical wiring and plumbing of the substructures may be interconnected at the factory, subject to each of the end substructures being rotated and laid on their respective sides for transport on trailer 1802 over streets and highways. In this case, flexible piping may be used to interconnect the plumbing of each substructure, and additional electrical wire may be used to allow for extra length needed when each end substructure is laid on its side.

In the embodiment shown in FIG. 18, middle substructure 1806 comprises a structure similar to structure 100 discussed extensively and previously herein, having a roof that is storable in order to do reduce the height of middle substructure 1806 for transport over public streets and highways. Each of the end substructures may comprise an additional room that adds living space to middle substructure 1806. In some embodiments, the end substructures, or rooms, are constructed in such a way as to withstand the force of gravity as each end substructure is rotated away from middle substructure 1806, as described below. Such construction may comprise additional bracing, welding and/or additional materials then what would normally be needed in a prior art construction. Each end section comprises a base 1820 and 1822, respectively, that forms a floor of each end substructure, and base 1820 rests near or against a side wall of middle substructure 1806 during transport of structure 1800, as will be discussed below.

Trailer 1802 typically spans at least the width of structure 1800, such as 50 feet or more while in a stowed position. In one embodiment, trailer 1802 comprises a frame 1812, at least one slidable section 1814 and in some embodiments, a center frame 1818. In the embodiment shown in FIG. 18, trailer 1802 additionally comprises another slidable section 1816. The slidable sections are slidably coupled to either end of frame 1812, used to move end structures 1804 and 1808 towards middle substructure 1806 after each of the end sections have been rotated on their side, as shown in the next few figures. Frame 1812 is typically coupled to multiple sets of axles and wheels in a number in order to support the weight of structure 1800. Center frame 1818 may be used to raise middle substructure 1806 so that it is substantially even with each end substructure on slidable sections 1814 and 1816.

Figure 19:
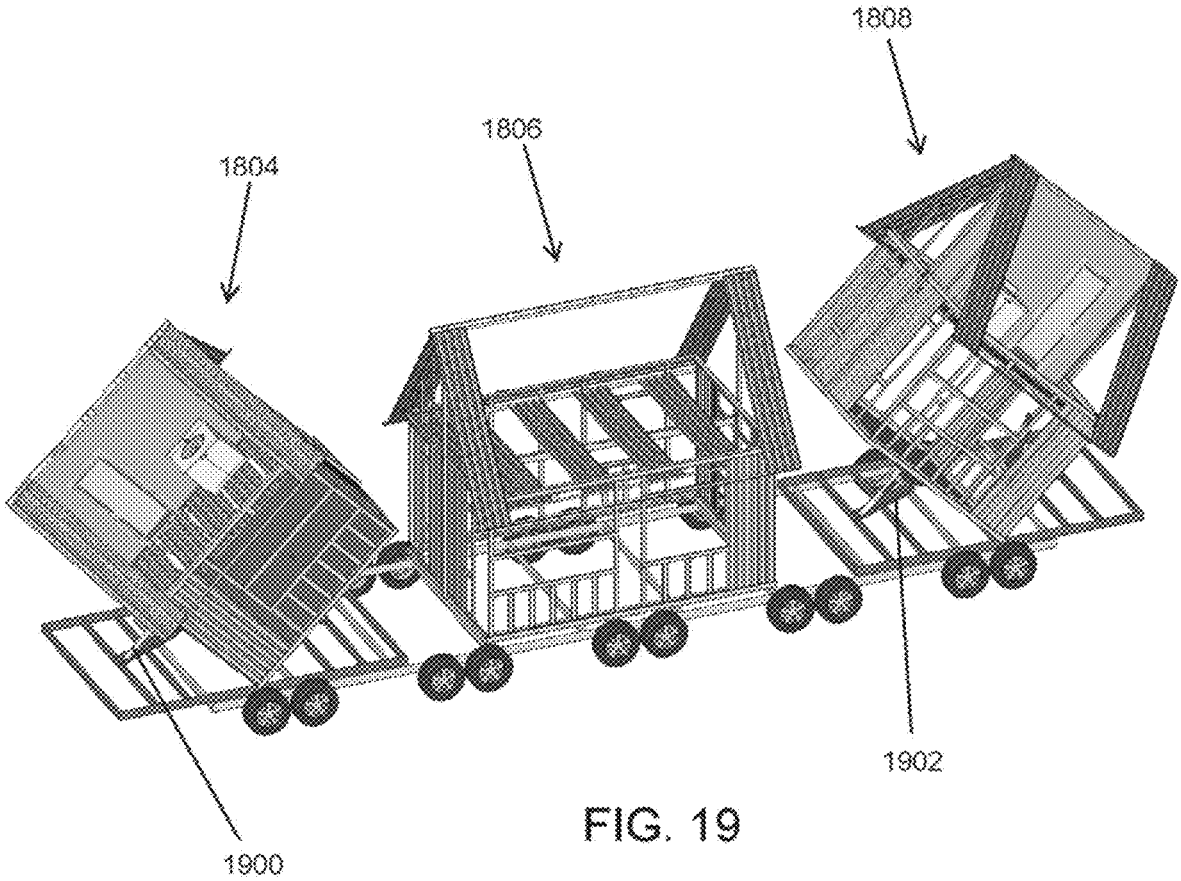
FIG. 19 is a perspective view of the structure as shown in FIG. 18 as a pair of end substructures are rotated on their respective sides.

FIG. 19 is a perspective view of structure 1800 as each of the end structures are rotated on their respective sides. Each end structure may be rotated manually or, as shown in FIG. 19, mechanically, in this case, using a first jack 1900 to rotate and substructure 1804 and a second jack 1902 to rotate substructure 1808. The jacks may be operated manually, pneumatically or hydraulically. In one embodiment, each of the jacks are mounted to frame 1812 of trailer 1802 such that each lies substantially within a plane formed by frame 1812 so that they do not interfere with either of the end substructures when the end substructures are in an upright position.

Figure 20:
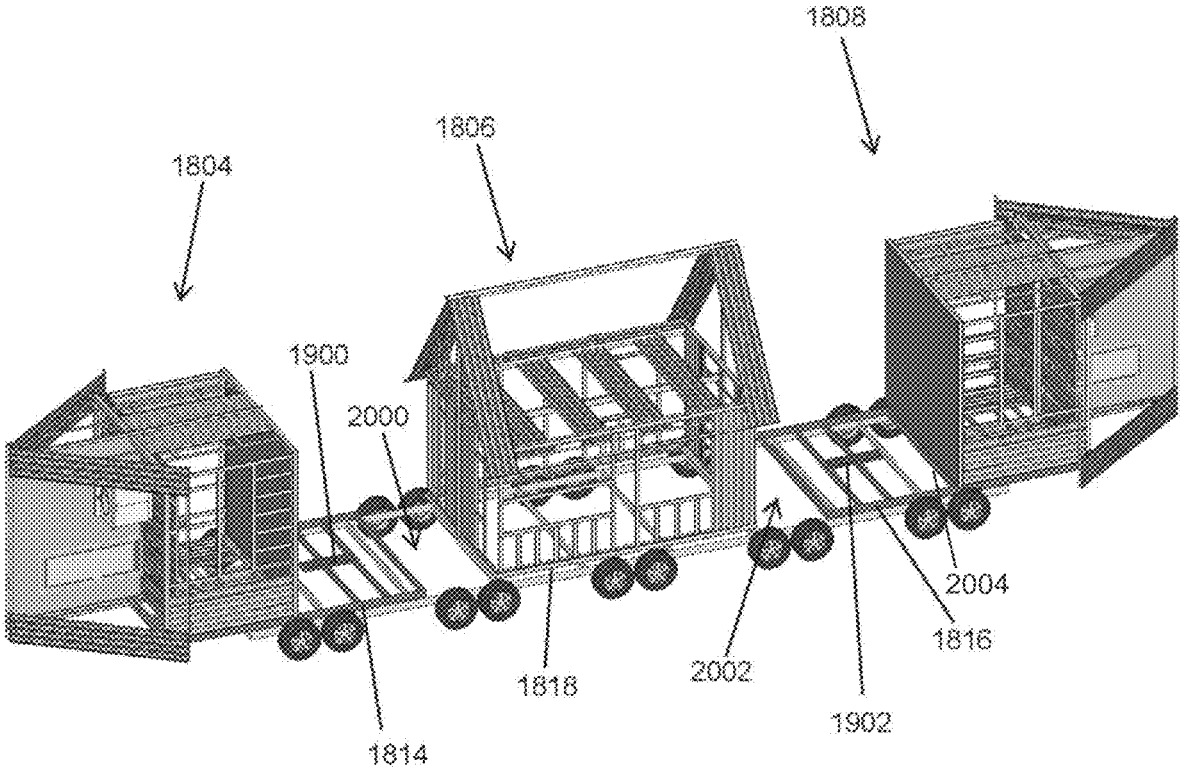
FIG. 20 is a perspective view of the structure as shown in FIG. 18 as each of the end structures have been laid down on their respective sides on top of a respective slidable section of a trailer.

FIG. 20 is a perspective view of structure 1800 as each of the end structures have been laid down on their respective sides on top of slidable section 1814 and slidable section 1816, respectively. As shown, Jack 1900 and jack 1902 have been fully retracted and lying within frame 1812. Note that in this embodiment, each of slidable section 1814 and 1816 are each positioned towards each end, respectively, of frame 1812, thereby leaving a gap 2000 and 2002, respectively between each end substructure and center frame 1818.

Figure 21:
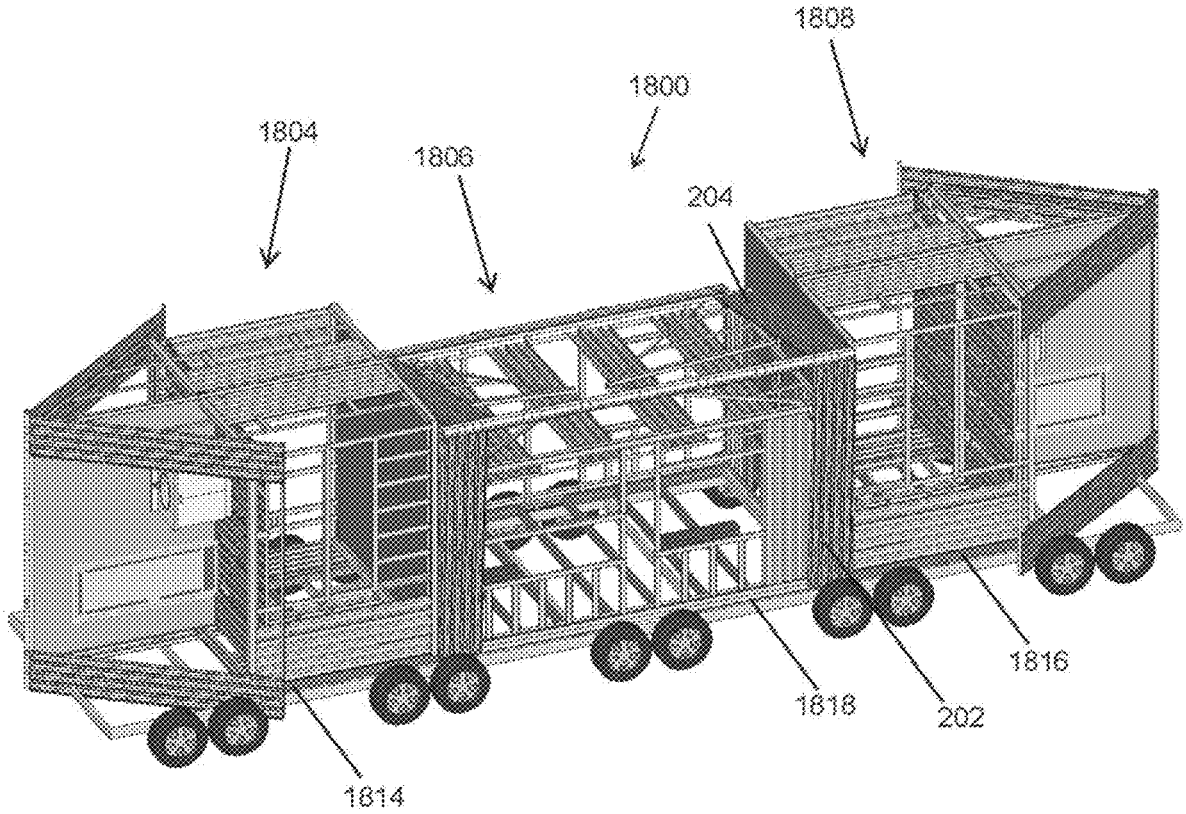
FIG. 21 is a perspective view of the structure as shown in FIG. 18 after each of the end structures have been slid against a middle substructure of the structure shown in FIG. 18.

FIG. 21 is a perspective view of structure 1800 after each of the end structures have been slid against middle substructure 1806 after slidable sections 1814 and 1816 have each been slid over frame 1812 and resting against center frame 1818. Also shown is first roof panel 202 lowered and resting against a side wall of middle substructure 1806, while second roof panel 204 is shown resting over a first-floor of middle substructure 1806, as described previously herein. In this position, the overall height of structure 1800 has been lowered so that structure 1800 can be moved to a construction site over public streets and highways, thus avoiding overhead power lines, communication lines and overpasses.

When structure 1800 arrives at the construction site, slidable sections 1814 and 1816 are slid over frame 1812, separating each of the end substructures from middle substructure 1806. The end substructures are then rotated so that they are once again in an upright position, wall-to-wall with the side walls of middle substructure 1806. Construction of structure 1800 may then be completed in a fraction of the time that it would take to construct structure 1800 on-site using traditional construction methods.

Figure 22:
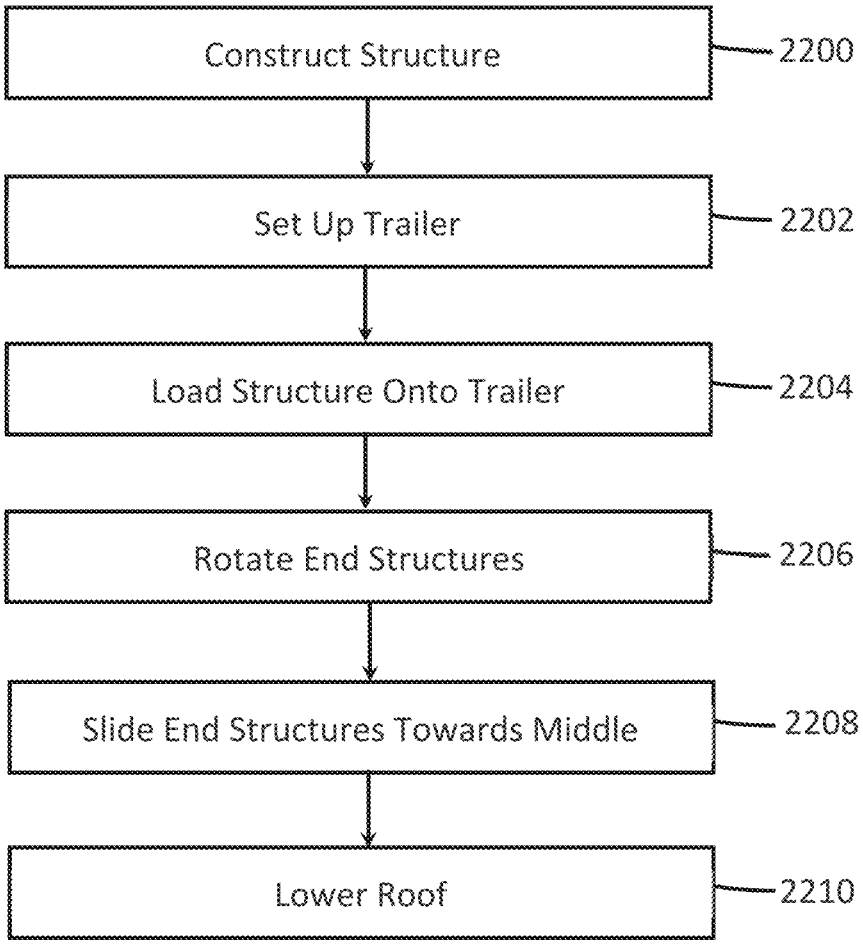
FIG. 22 is a method for configuring a structure for transport over public streets and highways.

FIG. 22 is a method for configuring a structure for transport over public streets and highways. The method is described with respect to structure 1800, although the inventive aspects of the method could be used in structures having a single end substructure.

At block 2200, structure 1800 is constructed at a location different from where structure 1800 will be permanently located, such as at a factory. Construction may comprise building the erecting walls, installing doors and windows, installing insulation, installing flooring, installing cabinets and fixtures, installing plumbing and electrical, etc. Each substructure 1804, 1806 and 1808 is constructed in a normal, upright position as shown in FIG. 18.

At block 2202, trailer 1802 is set up to receive structure 1800. Slidable section 1814 is positioned away from center frame 1818 over one end of frame 1812 while slidable section 1826 is positioned away from center frame 1818 over the other end of frame 1812.

At block 2204, each of the substructures are loaded onto a trailer 1802, as shown in FIG. 18. Middle substructure 1806 is placed onto center frame 1818, end substructure 1804 is placed onto slidable section 1814 and end substructure 1808 is placed onto slidable section 1816. Each end substructure abuts a respective side wall of middle substructure 1806, while uncoupled, allowing each end substructure to rotate away from each's respective side wall, as shown in FIG. 19. In some embodiments, only a portion of each end substructure's base 1820 and 1822 is in contact with a respective slidable section, as shown in FIG. 18.

At block 2206, each of the end substructures is rotated about an edge 1824 of end substructure 804 and an edge 2004 of end substructure 808, as shown in FIG. 19. Rotation may be accomplished manually, or with the aid of one or more devices, such as jacks 1900 and 1902, by crane, etc. Each end substructure is rotated until it comes to rest against slidable section 1814 and slidable section 1826, respectively. After rotation, a gap exists between each end substructure's base 1820 and 1822 and a respective side wall of middle substructure 1806.

At block 2208, each slidable section, along with its corresponding end substructure, is slid over frame 1812 towards center frame 1818, substantially or completely eliminating the gaps, until each base is in close proximity, or touching, a respective side wall of middle substructure 1806.

At block 2210, roof 200 of middle structure 1806 is lowered into the position shown in FIG. 21, where first roof panel 202 rests against a front wall of middle substructure 1806, while second roof panel 204 is shown resting over a first-floor of middle substructure 1806, as described previously herein. At this point, structure 1800 is ready for transport over public roads and highways, as the height of structure 1800 has been reduced substantially by rotation of the end substructures and lowering of roof 200.

FIG. 23 is a close-up, perspective, cutaway view of one embodiment of structure 100 where additional structural reinforcement is added in the form of configurable reinforcement means 1208, in this embodiment, comprising a slidable insert (not shown in this view) located inside a lower portion 2304 of upper vertical post 1204 and an upper portion 2306 of lower vertical post 1210, a slot 2302 formed longitudinally along upper portion 2306 and lower portion 2304, and fastener 2300. In the position shown, the slidable insert spans both upper portion 2306 and lower portion 2304 inside (as each beam is at least partially hollow near their ends), thereby preventing upper vertical post 1204 from folding with respect to lower vertical post 1210 as lateral loads are exerted against a gable wall. The slidable insert is held in place by fastener 2300 which, in this embodiment, is placed through slot 2302 and through the slidable insert, securing the slidable insert in place. When it is desired to fold a gable wall in preparation of transport of structure 100, the slidable insert is moved upwards by loosening fastener 2300 and using it to push the slidable insert upwards along slot 2302 until the slidable insert clears lower portion 2304 internally. At that point, fastener 2300 may then be tightened against upper vertical post 1204, thereby securing the slidable insert in place. In this position, upper vertical post 1204 is allowed to fold with respect to lower vertical post 1210 as a respective gable wall is folded into second story 106. It should be understood that in another embodiment, the view shown in FIG. 23 may represent slidable insert in a position fully inside lower vertical post 2302, thus allowing upper vertical post 1204 to rotate with respect to lower vertical post 1210. When desired to lock the beams to each other, fastener 2300 is used to position the slidable insert upwards, thereby positioning the slidable insert inside both upper portion 2306 and lower portion 2304.

The slidable insert is formed from a hard material able to withstand expected lateral loads on structure 100, such as metal, wood or a material such as carbon fiber, plastic, etc. The size and shape of the slidable insert substantially matches the internal size and shape of the hollow portions of both upper portion 2306 and lower portion 2304. Each of the beams may be sized and shaped similar to a typical "2×4", "2×8" or other typical building structural member. Fastener 2300 typically comprises a fastener, such as a bolt or a screw, fixed to the slidable insert so that the slidable insert moves vertically in response to movement of fastener 2300. Slot 2302 is formed into the ends of both upper portion 2306 and lower portion 2304, in one embodiment, formed further along lower portion 2304 than in upper portion 2306 (or vice-versa, depending on whether fastener 2300 is coupled to the slidable insert at a lower portion of the slidable insert (as shown) or, in another embodiment, towards an upper portion of the slidable insert). Slot 2302 comprises a width that is slightly larger than a shaft diameter of fastener 2300, thus allowing the shaft to move along slot 2302 as well as to move perpendicularly thereto during loosening and tightening of fastener 2302. Slot 2302 may comprise squared ends as shown, rounded ends, or comprise some other geometric shape.

FIG. 24 is a front, plan view of the configurable reinforcement means 1208 as shown in FIG. 23, shown in a locked position, illustrating slidable insert 2400 shown in hidden view, as well as the other components described with respect to FIG. 23. Note that the scale of the elements shown in FIG. 24 may not be in proportion to each other. In the position shown, slidable insert 2400 is in a locked position, spanning both upper portion 2306 of upper vertical post 1204 of a gable wall and lower portion 2304 of lower vertical post 1210 of a lower static wall 110 internally, thereby, preventing upper vertical post 1204 from moving with respect to lower vertical post 1210. Fastener 2300 is secured against the face of lower vertical post 1210 in order to secure slidable insert 2400 in place.

FIG. 25 is the same front, plan view of the configurable reinforcement means 1208 as shown in FIGS. 23 and 24, shown in an unlocked position, again illustrating slidable insert 2400 in hidden view, as well as the other components described with respect to FIGS. 23 and 24. Note again that the scale of the elements shown in FIG. 25 may not be in proportion to each other. In the position shown, slidable insert 2400 is in an unlocked position, moved so that it lies completely within upper portion 2306, thereby, allowing upper vertical post 1204 to move with respect to lower vertical post 1210, such as when a gable wall is being folded in preparation for transport. Fastener 2300 is secured against the face of upper vertical post 1204 in order to secure slidable insert 2400 in place.

In practice, when it is desired to fold roof 200 when configurable reinforcement means 1208 is used, fastener 2300 is first loosened so that slidable insert 2400 is free to move within upper portion 2306 and lower portion 2304. Then, fastener 2300 is slid along slot 2302, thereby sliding slidable insert 2400 into one of upper portion 2304 of lower vertical post 1210 or lower portion 2306 of upper vertical post 1204, thereby allowing upper vertical post 1204 to pivot with respect to lower vertical post 1210.

While the foregoing disclosure shows illustrative embodiments of the invention, it should be noted that various changes and modifications could be made herein without departing from the scope of the invention as defined by the appended claims. For example, in one embodiment, no pivot anchors or longitudinal slide arms are used, and each roof panel simply slides along an upper edge of first story 104. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

I claim:

1. A structure, comprising:

a top horizontal frame of a first story of the structure;

a first gable wall defining an upper portion of the structure, hingedly coupled to a first portion of the structure;

a second gable wall also defining the upper portion of the structure, hingedly coupled to a second portion of the structure;

a foldable roof, comprising: a first roof panel; a second roof panel; a ridge beam hinge that rotatably couples the first roof panel to the second roof panel; and an apex, the apex defining a maximum height of the structure when the foldable roof is in a deployed position and a height less than the maximum height when the foldable roof is in a stowed position;

at least two pivot anchors each coupled to a first portion of the top horizontal frame, each of the pivot anchors comprising a longitudinal slide arm, each slide arm rotatably coupled to each pivot anchor, respectively;

wherein each of the pivot anchors comprises a fixed tube coupled to a side surface of the first portion of the top horizontal frame at a location that is lower than the first portion of the top horizontal frame;

wherein the first roof panel comprises at least two longitudinal channels substantially parallel to each other, each of the channels sized and shaped to accommodate at least a portion of each of the longitudinal slide arms, respectively; and wherein the first roof panel is configured to slide along the longitudinal slide arms via the channels and rotate around an axis formed by the pivot anchors while an eave of the roof is lowered towards the ground.

2. The structure of claim 1, further comprising:

a first hinge that couples at least a portion of a lower edge of the first gable wall to the first portion of the structure; and a second hinge that couples at least a portion of a lower edge of the second gable wall to the second portion of the structure.

3. The structure of claim 1, further comprising:

a stopper coupled to at least one of the longitudinal channels that limits the first roof panel from sliding past a predetermined position when the foldable roof is in the deployed position.

4. The structure of claim 1, further comprising:

at least two additional pivot anchors coupled to a second, opposing portion of the top horizontal frame, each of the additional pivot anchors comprising an additional longitudinal slide arm, each rotatably coupled to the additional pivot anchors, respectively;

wherein the second roof panel comprises at least two additional, longitudinal channels substantially parallel to each other, each of the channels sized and shaped to accommodate at least a portion of each of the additional longitudinal slide arms, respectively;

wherein the second roof panel is configured to slide along the longitudinal slide arms via the additional, longitudinal channels and rotate around a second axis formed by the additional pivot anchors while the roof is being placed in the stowed position, allowing the second roof panel to lie substantially horizontally over the first story after the roof has been placed into the stowed position.

5. The structure of claim 3, further comprising:

a second stopper coupled to at least one of the longitudinal channels of the second roof panel, for preventing the second roof panel from sliding past a second predetermined position while the foldable roof is in the deployed position.

6. The structure of claim 1, further comprising:

a first, first story wall; and a first end substructure lying on its side, positioned with a base of the first end substructure proximate to the first, first story wall.

7. The structure of claim 6, further comprising:

a trailer comprising:

a frame;

a first slidable section slidably coupled to a first end of the frame;

wherein the first slidable section is configured to support the first end substructure lying on its side and to slide the first end substructure proximate to the first story wall.

8. The structure of claim 6, further comprising:

a second, first story wall opposite the first, first story wall;

a second end substructure lying on its side, positioned with a base of the second end substructure proximate to the second, first story wall.

9. The structure of claim 8, further comprising:

a trailer comprising:

a frame;

a first slidable section slidably coupled to a first end of the frame;

a second slidable section slidably coupled to a second end of the frame;

wherein the first slidable section is configured to support the first end substructure lying on its side and to slide the first end substructure proximate to the first story wall during transport of the structure, and the second slidable section is configured to support the second end substructure lying on its side and to slide the second end substructure proximate to the second, first story wall during transport of the structure.

10. A structure, comprising:

a top horizontal frame of a first story of the structure;

a first gable wall defining an upper portion of the structure, hingedly coupled to a first portion of the structure;

a second gable wall also defining the upper portion of the structure, hingedly coupled to a second portion of the structure;

a foldable roof, comprising an apex, the apex defining a maximum height of the structure when the foldable roof is in a deployed position and a height less than the maximum height when the foldable roof is in a stowed position;

a lower static wall comprising a lower vertical post, the lower vertical post comprising a hollow upper portion;

an upper vertical post of the first gable wall in substantial longitudinal alignment with the lower vertical post and comprising a hollow lower portion;

a slot formed longitudinally into the end portions of the beams;

a slidable insert located within the hollow portions of one or both beams; and a fastener for securing the slidable insert in a first locked position, whereby the slidable insert spans both the hollow lower section of the upper vertical post and the hollow upper section of the lower vertical post, and for securing the slidable insert in a second locked position, whereby the slidable insert lies completely within one of the hollow lower section of the upper vertical post and the hollow upper section of the lower vertical post.

11. The structure of claim 10, wherein the foldable roof comprises:

a first roof panel;

a second roof panel; and a ridge beam hinge that rotatably couples the first roof panel to the second roof panel.

12. The structure of claim 11, further comprising:

at least two pivot anchors each coupled to a first portion of the top horizontal frame, each of the pivot anchors comprising a longitudinal slide arm, each slide arm rotatably coupled to each pivot anchor, respectively;

wherein the first roof panel comprises at least two longitudinal channels substantially parallel to each other, each of the channels sized and shaped to accommodate at least a portion of each of the longitudinal slide arms, respectively; and wherein the first roof panel is configured to slide along the longitudinal slide arms via the channels and rotate around an axis formed by the pivot anchors while an eave of the roof is lowered towards the ground.

13. The structure of claim 12, wherein each of the pivot anchors comprises a fixed tube coupled to a side surface of the first portion of the top horizontal frame at a location that is lower than the first portion of the top horizontal frame.

14. A structure, comprising:

a top horizontal frame of a first story of the structure;

a first gable wall defining an upper portion of the structure, hingedly coupled to a first portion of the structure;

a second gable wall also defining the upper portion of the structure, hingedly coupled to a second portion of the structure;

a foldable roof, comprising: a first roof panel; a second roof panel; a ridge beam hinge that rotatably couples the first roof panel to the second roof panel; and an apex, the apex defining a maximum height of the structure when the foldable roof is in a deployed position and a height less than the maximum height when the foldable roof is in a stowed position; and at least two additional pivot anchors coupled to a second, opposing portion of the top horizontal frame, each of the additional pivot anchors comprising an additional longitudinal slide arm, each rotatably coupled to the additional pivot anchors, respectively;

wherein the second roof panel comprises at least two additional, longitudinal channels substantially parallel to each other, each of the channels sized and shaped to accommodate at least a portion of each of the additional longitudinal slide arms, respectively;

wherein the second roof panel is configured to slide along the longitudinal slide arms via the additional, longitudinal channels and rotate around a second axis formed by the additional pivot anchors while the roof is being placed in the stowed position, allowing the second roof panel to lie substantially horizontally over the first story after the roof has been placed into the stowed position; and wherein each of the additional pivot anchors comprises a tubular fixed portion coupled to a side surface of the second portion of the top horizontal frame, wherein the tubular fixed portion is substantially even, or higher, than a top, horizontal surface of the second portion of the top horizontal frame.

15. The structure of claim 14, further comprising:

a first hinge that couples at least a portion of a lower edge of the first gable wall to the first portion of the structure; and a second hinge that couples at least a portion of a lower edge of the second gable wall to the second portion of the structure.

16. A method for stowing a foldable structure, comprising:

rotating a first gable wall inwards over a top of a first story of the structure via a first hinge that couples the first gable wall to the structure;

rotating a second gable wall inwards over the first gable wall via a second hinge that couples the second gable wall to the structure; and folding a roof of the structure, wherein folding the roof reduces a height of the structure from a first height to a second, lower height;

wherein folding the roof comprises:

lowering a first roof panel of the roof by sliding the first roof panel along two or more rotatable longitudinal slide arms coupled to a first frame member of a top horizontal frame that defines an upper portion of the first story, thereby causing the first roof panel to pivot with respect to a second roof panel coupled to the first roof panel via a roof ridge hinge.

17. The method of claim 16, wherein sliding the first roof panel along two or more rotatable longitudinal slide arms comprises sliding the first roof panel along the rotatable longitudinal slide arms via two or more channels, respectively, formed into the first roof panel.

18. The method of claim 16, wherein the second roof panel is slidably coupled to at least two additional longitudinal slide arms coupled to a second frame member of the top horizontal frame opposing the first frame member, and to the first roof panel via a hinge, wherein the second roof panel slides across the additional longitudinal slide arms and rotates with respect to the first roof panel into a substantially horizontal position over the first story after the roof has placed into a stowed position.

19. The method of claim 16, further comprising:

constructing a first end substructure to supplement the structure;

rotating the first end substructure on its side; and sliding the first end substructure so that it rests in proximity to a side wall of the structure.

20. The method of claim 19, further comprising:

constructing a second end substructure to supplement the structure;

rotating the second end substructure on its side; and sliding the second end substructure so that it rests in proximity to a side wall of the structure.

21. The method of claim 19, further comprising:

loosening a fastener that secures a slidable insert within an upper portion of a lower vertical post of the structure and a lower portion of an upper vertical post of the first gable wall; and sliding the fastener along a slot formed longitudinally in the upper portion and the lower portion, thereby sliding the slidable insert into one of the upper portion or the lower portion, thereby allowing the upper vertical post to pivot with respect to the lower vertical post.

* * * * *